US007288024B2

(12) United States Patent
Toyoda

(10) Patent No.: US 7,288,024 B2
(45) Date of Patent: Oct. 30, 2007

(54) GAMING MACHINE, SERVER AND PROGRAM FOR CARD GAME

(75) Inventor: Hirobumi Toyoda, Tokyo (JP)

(73) Assignee: Aruze Co., Ltd. (JP)

( * ) Notice: Subject to any disclaimer, the term of this patent is extended or adjusted under 35 U.S.C. 154(b) by 878 days.

(21) Appl. No.: 10/612,301

(22) Filed: Jul. 3, 2003

(65) Prior Publication Data

US 2004/0072602 A1 Apr. 15, 2004

(30) Foreign Application Priority Data

Jul. 4, 2002 (JP) ..... 2002-196184

(51) Int. Cl.
*A63F 9/24* (2006.01)

(52) U.S. Cl. ..... 463/13; 463/16; 463/25

(58) Field of Classification Search ..... None
See application file for complete search history.

(56) References Cited

U.S. PATENT DOCUMENTS

| | | | | |
|---|---|---|---|---|
| 4,760,527 | A * | 7/1988 | Sidley | 463/13 |
| 5,046,736 | A * | 9/1991 | Bridgeman et al. | 463/13 |
| 5,221,083 | A * | 6/1993 | Dote | 463/32 |
| 5,707,285 | A * | 1/1998 | Place et al. | 463/12 |
| 5,743,800 | A * | 4/1998 | Huard et al. | 463/26 |
| 5,941,770 | A * | 8/1999 | Miers et al. | 463/13 |
| 6,039,648 | A * | 3/2000 | Guinn et al. | 463/16 |
| 6,287,202 | B1 * | 9/2001 | Pascal et al. | 463/42 |
| 2002/0039923 | A1 | 4/2002 | Cannon et al. | |
| 2002/0065123 | A1 | 5/2002 | Packes, Jr., et al. | |

FOREIGN PATENT DOCUMENTS

| | | |
|---|---|---|
| EP | 0843272 | 5/1998 |
| JP | 6-182053 | 7/1994 |
| JP | 07-155470 | 6/1995 |
| JP | 8-84863 | 4/1996 |
| JP | 9-94350 | 4/1997 |
| JP | 10-21312 | 1/1998 |
| JP | 10-85450 | 4/1998 |
| JP | 10-108974 | 4/1998 |
| JP | 10-235017 | 9/1998 |
| JP | 11-179056 | 7/1999 |
| JP | 11-319319 | 11/1999 |

(Continued)

OTHER PUBLICATIONS

SWFTE International Ltd's Playing Bicycle Poker, by Wesley Steiner, 9pages, Jan. 22, 1994.*

(Continued)

*Primary Examiner*—Mark Sager
(74) *Attorney, Agent, or Firm*—Antonelli, Terry, Stout & Kraus, LLP

(57) ABSTRACT

A gaming machine, with which a plurality of players who join a game from the beginning can enjoy the game by the end of the game, is provided. The gaming machine is equipped with a rank determination means and a win/loss determination means to provide the gaming machine with an arrangement by which players provided with benefits are determined so as to be a combination of the player of the highest rank as determined by the above-mentioned rank determination means and players of ranks that are not in the order of results starting from the highest rank.

8 Claims, 15 Drawing Sheets

FOREIGN PATENT DOCUMENTS

| | | |
|---|---|---|
| JP | 2000-126458 | 5/2000 |
| JP | 2000-167253 | 6/2000 |
| JP | 2000-233069 | 8/2000 |
| JP | 2000-233075 | 8/2000 |
| JP | 2001-96063 | 4/2001 |
| JP | 2001-155061 | 6/2001 |
| JP | 2001-204871 | 7/2001 |
| JP | 2001-216416 | 8/2001 |
| JP | 2001-224863 | 8/2001 |
| JP | 2001-297200 | 10/2001 |
| JP | 2001-340646 | 12/2001 |
| JP | 2001-347076 | 12/2001 |
| JP | 2002-35413 | 2/2002 |
| JP | 2002-165916 | 6/2002 |
| JP | 2002-191740 | 7/2002 |
| JP | 2002-336551 | 11/2002 |
| JP | 2002-360935 | 12/2002 |
| JP | 2003-76808 | 3/2003 |
| JP | 2003-117243 | 4/2003 |

OTHER PUBLICATIONS

Scarne's Encyclopedia of Games, by John Scarne, Harper & Row Publishers, copyright 1973, pp. 6-38, esp. 6-11, 22-23, 39-42.*

* cited by examiner

Fig. 12

Player Data Table

| | Entry flag A | End-of-game flag B | Dealt card data C1 | Dealt card data C2 | Dealt card data C3 | Dealt card data C4 | Dealt card data C5 | Dealt card data C6 | Dealt card data C7 | Strongest winning combination data D | Weakest winning combinatio n data E | Winner flag F |
|---|---|---|---|---|---|---|---|---|---|---|---|---|
| P1 | 1 | 0 | 3A | 17 | 14 | 2A | 12 | 19 | 15 | 5 | 9 | 1 |
| P2 | 0 | 1 | .. | .. | .. | .. | .. | .. | .. | .. | .. | 0 |
| P3 | 0 | 0 | .. | .. | .. | .. | .. | .. | .. | .. | .. | 1 |
| P4 | 0 | 0 | .. | .. | .. | .. | .. | .. | .. | .. | .. | 0 |

Fig. 13

Winning Combination Determination Table

| Type of winning combination | Winning combination rank data |
|---|---|
| Royal straight flush | 1 |
| Straight flush | 2 |
| Four of a kind | 3 |
| Full house | 4 |
| Flush | 5 |
| Straight | 6 |
| Three of a kind | 7 |
| Two pair | 8 |
| One pair | 9 |

Fig. 14A

Strongest Winning Combination
Rank Determination Data

| Ranking | Winner identification data |
|---|---|
| 1 | P1 |
| 2 | .. |
| 3 | .. |
| 4 | .. |

Fig. 14B

Weakest Winning Combination
Rank Determination Data

| Ranking | Winner identification data |
|---|---|
| 1 | .. |
| 2 | .. |
| 3 | .. |
| 4 | P3 |

GAMING MACHINE, SERVER AND PROGRAM FOR CARD GAME

CROSS-REFERENCE TO RELATED APPLICATIONS

This application is based upon and claims the benefit of priority from the prior Japanese Patent Application No. 2002-196184 filed on Jul. 4th in 2002, the entire contents of which are incorporated herein by reference.

This application is related to co-pending U.S. patent applications entitled "Gaming Machine, Server and Program for Plural Players" and "Gaming Machine, Server, and Program", respectively, both applications being filed on even date herewith. The co-pending applications are expressly incorporated herein by reference.

BACKGROUND OF THE INVENTION

1. Field of the Invention

This invention relates to a gaming machine, that executes a card game, such as poker, etc., utilizing a video screen, 2. Related Art In a conventional gaming machine, with which a plurality of players participate and play a game competing with each other, a card game such as a poker game is carried out utilizing a video screen thereof. With such type of gaming machine, a specific number of cards are dealt to each player to make the player's hand, and if a combination that is set as a winning combination is included in the player's hand and if this combination is a combination that is set as a stronger winning combination than those of other players, a predetermined benefit is provided to the player.

With such a gaming machine, since the win or loss is determined by comparison of the game results of the respective players, the key to whether a player wins or loses and gains a large amount of benefit lies in how much better a game result a player achieves in comparison to other players.

Thus in a case where a game is arranged so that only one player will be a winner and be provided with benefit, each player plays the game while constantly intending to achieve a better game result than other players.

Meanwhile, Laid-open Japanese Patent Publication No. 2001-340646 proposes in a gaming machine, with which a plurality of players participate and play a game competing with each other, a game being carried out by players who may form a team and cooperate for the purpose of achieving good results.

This invention is arranged so that the team, to which the player who achieved the best game result belongs, becomes the winner, or points are given according to the rank of game results to a plurality of upper ranking players starting with the player who achieved the best result, and the team with the highest total points becomes the winner, and also, so that benefits can be provided to a plurality of players.

Even if, as in the above-described invention, arrangements are made so that a plurality of players will be winners who are provided with benefits, as long as how excellent a game result is achieved determines the win or loss and is the key to gaining a large amount of benefit, a player will still play the game while constantly intending to achieve a better game result than other players.

However, with a gaming machine, with which how excellent a game result is achieved determines the win or loss and is the key to gaining a large amount of benefit as described above, even if a player plays the game intending to achieve a better game result than the other players, since the win or loss will be affected by luck, the degree of expertise in the game, etc., there will be on one hand players who can achieve excellent game results and on the other hand many players who cannot achieve excellent results. Also, since a player, in the process of playing a game, will be playing the game while visually recognizing or predicting the position of his/her own game result with respect to those of other players, if the player comes to predict that he/she cannot achieve a game result that is better than the game results of other players, the player will, in many cases, lose the will to play the game.

Also, even in a card game where a plurality of players participate and play competing with each other as described above, only the player with the strongest hand can become a winner or, even in a case where a plurality of players can become winners, the winners will only be the plurality of upper ranking players starting with the player with the strongest hand. Thus in many cases, a player with only a weak hand who judges that there is no way of winning, may lose his courage to continue to play the game and quit without continuing the game to the end.

Furthermore, with such a card game as described above, the total amount of money bet by the respective players is paid to the winning player at the end of the game.

Thus in a case where there are many players who quit and do not continue to play a game until the end, the total amount of bet money to be gained by the winner decreases correspondingly, and even a player who has come to have a strong hand may thus deteriorate his motivation to continue to play the game.

Furthermore, it can be said that with a card game such as that described above, the various tactical interactions, which are developed among players from the point at which the hands are dealt to the point at which the contents of one's hands are revealed, make up a main point of interest of the game, and thus in case where there are many players who quit and do not continue to play the game to the end, a player may not be able to adequately enjoy the tactical interactions, which make up an interesting part of the game, and may lose interest in the game.

In view of the above points, it is preferable for a player that a gaming machine be one with which the opportunity to enjoy tactical interactions will not decrease and that the total amount of bet money gained by winning the game will not decrease due to players quitting the game.

SUMMARY OF THE INVENTION

This invention has been made in view of the above points and an object thereof is to provide a card gaming machine, with which all players participating in a game can enjoy the game to the end.

In order to achieve the above object, with the present invention, a gaming machine is comprised of a rank determination means and a win/loss determination means so that players who are provided with benefits are determined to be a combination of the highest ranking player and one or more players with ranks that are not in the order of a regular ranking from the top to the bottom.

More specifically, the following is provided according to the present invention.

(1) A gaming machine comprises: a game control means for controlling a card game that is played by a plurality of players including a virtual player; and a benefit provision means for providing benefits to said players in accordance with game media used in the card game. The gaming machine further comprises: a rank determination means for determining a player ranking in accordance with a result of the card game; and a win/loss determination means for determining winning players among the plurality of players to be provided with benefits based on the player ranking determined by said rank determination means; wherein said win/loss determination means determines the winning players such that the winning players include a highest ranking player and a player other than a second highest ranking player according to the player ranking.

According to the present invention, since a gaming machine having a game control means for controlling a card game that is played by a plurality of players including a virtual player; and a benefit provision means for providing benefits to the above-mentioned players in accordance with game media used in the above-mentioned game is further composed of a rank determination means for determining a ranking in accordance with the results of the above-mentioned game; and a win/loss determination means for determining a plurality of players to be provided with the above-mentioned benefits in accordance with the ranking determined by the above-mentioned rank determination means such that the above-mentioned win/loss determination means determines the plurality of players to be provided with the above-mentioned benefits so that the plurality of players include a combination of the player with the highest rank as determined by the above-mentioned rank determination means and players of ranks that are not in the order of results starting from the highest rank, benefits can be provided to the player with the highest rank As well as to players whose ranks are not in the order of ranks starting from the highest rank as a result of the game.

Therefore, winning players may be composed of the player with the highest rank as well as to players whose ranks are not in the order of ranks starting from the highest rank. The ranks are usually listed in the descending order from the highest rank so as to make a player ranking as a result of a card game. The highest ranking player is supposed to get a benefit such as game media and the second highest ranking player may expect some. However, according to the present invention, the second highest ranking player may not get such benefit. A player who is included in the winning players other than the highest ranking player may be selected, for example, by a lottery.

Though normally in the process of playing a game, a player, who comes to predict that his/her rank will not be the highest and the provision of benefit cannot be expected, may lose the motivation to continue to play the game and give up the game, with this invention, since arrangements are made to provide benefits not only to the player with the highest rank but also to players whose ranks are not in the order of ranks starting from the highest rank and a player is thus left with the possibility of being provided with benefit until the game is finally ended even if his/her rank is not the highest, a situation, where all players participating in the game lose the motivation to play the game, is prevented and the possibility that the game can be enjoyed to the end is increased.

(2) The gaming machine according to (1) is characterized in that said win/loss determination means determines the winning players for the benefits so that the winning players include a lowest ranking player according to the player ranking.

According to the present invention, since the gaming machine is arranged such that the above-mentioned win/loss determination means determines the plurality of players to be provided with the above-mentioned benefits so that the plurality of players to be provided with the above-mentioned benefits include the player with the lowest rank as determined by the above-mentioned rank determination means, benefits can be provided to the player with the highest rank as well as to the player with the lowest rank as a result of the game.

Though normally in the process of playing a game, a player, who comes to predict that his/her rank will not be the highest and the provision of benefit cannot be expected, may lose the motivation to continue to play the game and give up, with the present invention, since arrangements are made to provide benefits not only to the player with the highest rank but also to the player with the lowest rank and thus even if a player predicts that his/her rank will be of low rank, since a benefit will be provided if the rank is the lowest and the player is thus left with the possibility of being provided with benefit until the game is finally ended, the possibility that all players participating in the game will be able to enjoy the game to the end without losing the motivation to continue to play the game is increased.

(3) A gaming machine with which a card game is played by a plurality of players including a virtual player and which provides benefits to winning players among the plurality of players in accordance with game media used in the card game is characterized in that said wining players are determined to include a highest ranking player and a player other than a second highest player according to a result of the card game.

According to the present invention, since a gaming machine is arranged, with which a game using cards is played by a plurality of players including a virtual player so that benefits are provided to the above-mentioned players in accordance with game media used in the above-mentioned game, the plurality of players to be provided with the above-mentioned benefits are determined so as to comprise a combination of the player with the highest rank as determined according to a result of the above-mentioned game and players of ranks that are not in the order of results starting with the highest rank. Therefore, benefits can be provided, as a result of the game, to the player with the highest rank as well as to players whose ranks are not in the order of ranks starting from the highest rank.

Though normally in the process of playing a game, a player, who comes to predict that his/her rank will not be the highest and the provision of benefit cannot be expected, may lose the motivation to continue to play the game and give up, with this invention, since arrangements are made to provide benefits not only to the player with the highest rank but also to players whose ranks are not in the order of ranks starting from the highest rank and a player is thus left with the possibility of being provided with benefit until the game is finally ended even if his/her rank is not the highest, a situation, where all players participating in the game lose the motivation to continue to play the game, is prevented and the possibility that the game can be enjoyed to the end is increased.

(4) A gaming machine with which a plurality of players play a game individually using game media comprises: individual display parts, each of which shows an individual game content for a respective player; a common display part which shows common information shared with other players; and operating parts, each of which is operated by each individual player; wherein the gaming machine provides benefits to a highest ranking player and a player other than the highest ranking player, but being selected by a predetermined criterion.

With the above, that a plurality of players play a game independent of each other may mean that each individual player plays the game on his/her own judgment. The individual display parts may include display devices that display to each of these players individually. The common display part displaying information shared with other players is a means by which a player discloses information that may be provided to other players and may include a common display device. The predetermined criterion may, for example, be set to select the lowest rank, the second lowest rank, etc. Such criterion may be determined according to gaming machine or may be changed for each game, (5) A server is provided connectable via a communication line to terminal devices, each of which has information input means for inputting information. The server comprises: a game control means for controlling a card game played by a plurality of players including a virtual player, the game control means being provided with each of said terminal devices; and a benefit provision means for providing benefits to the players in accordance with input information by the players. The server further comprises: a rank determination means for determining a ranking in accordance with a result of the game; and a win/loss determination means for determining winning players by the ranking such that the wining players are determined to include a highest ranking player and a player other than a second highest player according to the ranking.

According to the present invention, since a server which is connectable via a communication line to terminal devices that have information input means for inputting information and comprise: a game control means for performing control of a game using cards that is played by a plurality of players including virtual players; and a benefit provision means for providing benefits to the above-mentioned players in accordance with input information by the above-mentioned players is composed of a rank determination means for determining ranks in accordance with the results of the above-mentioned game; and a win/loss determination means for determining a plurality of players to be provided with the above-mentioned benefits in accordance with the ranks determined by the above-mentioned rank determination means. The above-mentioned win/loss determination means has a function of performing control to determine the plurality of players to be provided with the above-mentioned benefits so that the plurality of players to be provided with the above-mentioned benefits include a combination of the player with the highest rank as determined by the above-mentioned rank determination means and players of ranks that are not in the order of results starting with the highest rank. Therefore, benefits can be provided, as a result of the game, to the player with the highest rank as well as to players whose ranks are not in the order of ranks starting from the highest rank.

Though normally in the process of playing a game, a player, who comes to predict that his/her rank will not be the highest and the provision of benefit cannot be expected, may lose the motivation to continue to play the game and give up, with this invention, since arrangements are made to provide benefits not only to the player with the highest rank but also to players whose ranks are not in the order of ranks starting from the highest rank and a player is thus left with the possibility of being provided with benefit until th game is finally ended even if his/her rank is not the highest, a situation, where all players participating in the game lose the motivation to play the game, is prevented and the possibility that the game can be enjoyed to the end is increased.

Furthermore, the above arrangement gives rise to the possibility of centralized control of gaming machines from a remote location and provides the above-mentioned effects without requiring the setting of each gaming machine and other troublesome work.

(6) A computer executable program comprises: controlling a card game that is played by a plurality of players including a virtual player; and providing benefits to players in accordance with game media used in the game. The program further comprising: determining a high-low ranking in accordance with a result of the game; and determining winning players to be provided with benefits such that the winning players include a highest ranking player and a player other than a second highest ranking player.

According to the present invention, since a computer is made to execute a game control step of controlling a game using cards that is played by a plurality of players including virtual players; and a benefit provision step of making benefits be provided to players in accordance with game media used in the above-mentioned game and since the computer is made to execute a rank determination step of making ranks determined in accordance with the results of the above-mentioned game; and a win/loss determination step of making a plurality of players to be provided with the above-mentioned benefits be determined so as to be a combination of the player with the highest rank as determined in the above-mentioned rank determination step and players of ranks that are not in the order of results starting with the highest rank, benefits can be provided, as a result of the game, to the player with the highest rank as well as to players whose ranks are not in the order of ranks starting from the highest rank.

Though normally in the process of playing a game, a player, who comes to predict that his/her rank will not be the highest and the provision of benefit cannot be expected, may lose the motivation to continue to play the game and give up, with this invention, since arrangements are made to provide benefits not only to the player with the highest rank but also to players whose ranks are not in the order of ranks starting from the highest rank and a player is thus left with the possibility of being provided with benefit until the game is finally ended even if his/her rank is not the highest, a situation, where all players participating in the game lose the motivation to continue to play the game, is prevented and the possibility that the game can be enjoyed to the end is increased.

Furthermore, such a program may be readable by a computer and may be stored in a storage medium of a gaming machine itself or a server, etc. Yet furthermore, such a program may be stored in a storage medium incorporated in an equipment of another arrangement or may be stored in a divided manner in storage media incorporated in a gaming machine and a server.

[Definition of terms, etc.]

A "benefit" refers to the game condition being a beneficial condition for a player and, for example, includes medals, pachinko balls, credits, or other form of game currency or media as well as a bonus game that provides the right to play a game free of charge, etc.

A "rank" may indicate the relationship of superiority or inferiority of game results among players and indicates a relative positional relationship in a comparison based on the superiority or inferiority with respect to other players.

An "order of results" may indicate a state in which ranks are set in a regular, consecutive order starting with the most excellent rank.

A "combination of the player with the highest rank and players of ranks that are not in the order of results starting with the highest rank" may indicate, for example in a case where such a combination is to be formed by selecting two ranks from among the ranks from first place to fifth place, the combinations besides the combination of "first place and second place," that is, the combinations of "first place and third place," "first place and fourth place," and "first place and fifth place."

Further features of the invention, its nature and various advantages will be more apparent from the accompanying drawings and the following detailed description of the invention.

BRIEF DESCRIPTION OF THE DRAWINGS

FIG. 12 shows a player data table of the gaming machine according to an embodiment of the present invention.

FIG. 13 shows a winning combination determination table of the gaming machine according to an embodiment of the present invention.

FIG. 14A shows a determination data table for strongest winning combination of the gaming machine according to an embodiment of the present invention.

FIG. 14B shows a determination data table for weakest winning combination of the gaming machine according to an embodiment of the present invention.

DETAILED DESCRIPTION OF THE INVENTION

Figure 1:
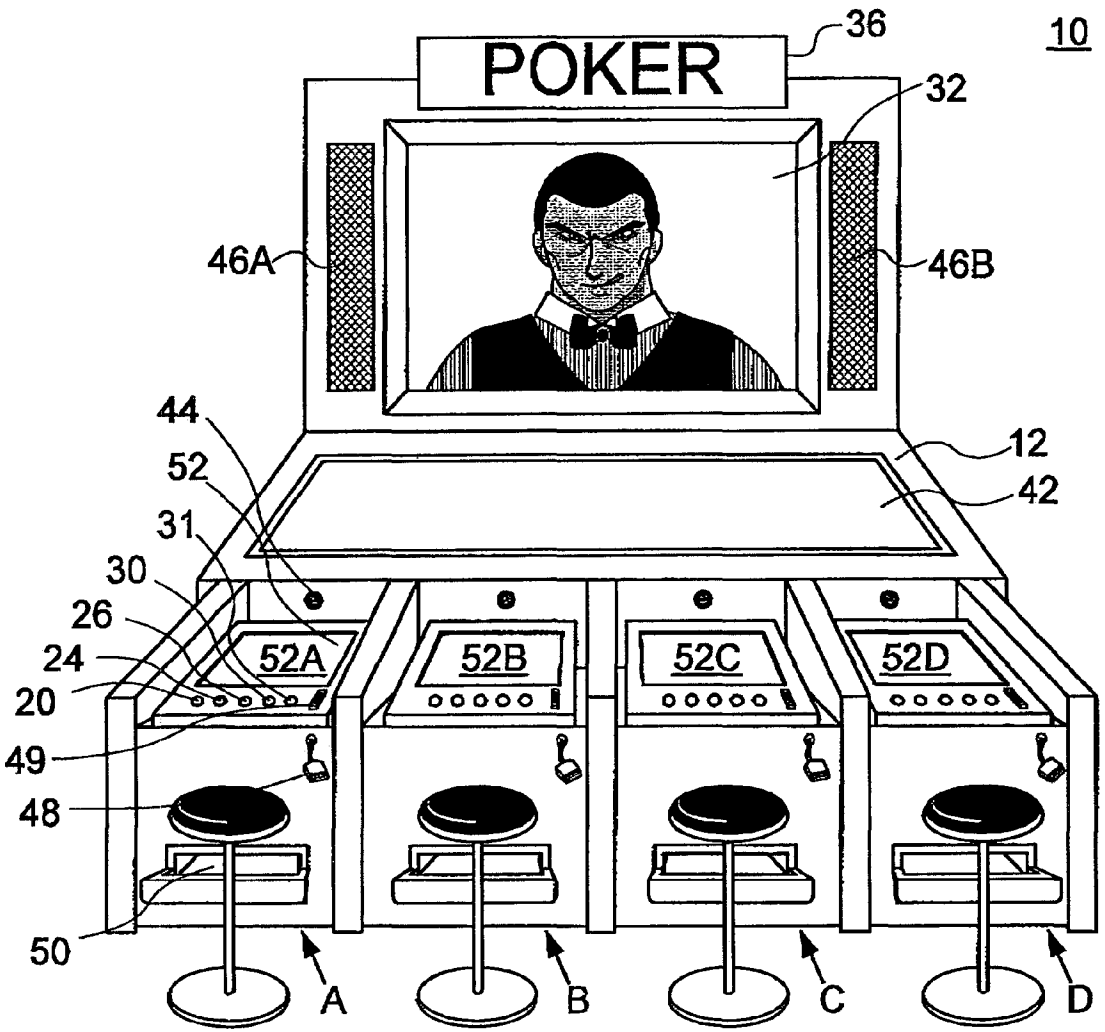
FIG. 1 is a front view showing the general appearance of a gaming machine according to an embodiment of the present invention.

A preferred embodiment of this invention shall now be described referring to the drawings.

With the embodiment described below, a case where this invention is applied to a gaming machine which performs a poker game will be described as a preferred embodiment of the present invention.

This invention may be applied not only to a poker game but may also be applied to a blackjack game, a Japanese flower card game or other card game.

[Arrangement of a Gaming Machine]

FIG. 1 is a front view showing the general appearance of a gaming machine 10. Though gaming machine 10 is a gaming machine that enables playing by use of coins, medals, tokens or other form of game currency or media or card, etc., which stores information on game currency, in the following description, by way of example, medals are used.

Figure 4A:
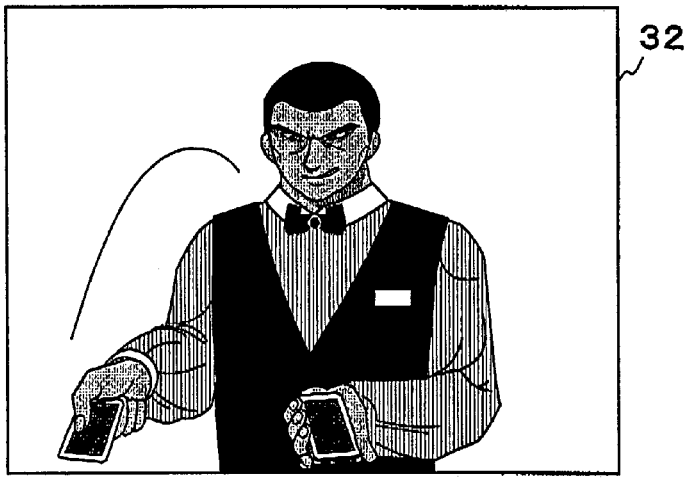
FIG. 4A is a schematic view showing a screen display of a dealer display device of the gaming machine according to an embodiment of the present invention.

A dealer display device 32 is equipped on the front face of a casing 12 that forms the entirety of gaming machine 10, and a dealer image is displayed on this dealer display device 32. This dealer image deals cards to individual display devices 52 (52A to 52D) to be described later (see FIGS. 4A-4C). The respective players participating in the poker game proceeds with the game while viewing the dealer displayed on this display device 32.

Speakers 46 (46A and 46B) are equipped at both sides of dealer display device 32 and emit the voice emitted by the dealer, background music, and other effect sounds for effective dramatic presentation of the poker game.

Furthermore, a card dealing display device 42 is equipped on the upper face of casing 12 and displays cards, etc., dealt by the dealer image, displayed on display device 32. At this time, the first two cards that are dealt are displayed in a down-facing manner so that other players cannot visually recognize the designs while the remaining cards are displayed in an up-facing manner so that other players can visually recognize the designs (see FIG. 4B). Medal images, indicating the numbers of medals bet by the respective players, are also displayed.

Though with gaming machine 10 of this embodiment, display device 42 is equipped and the contents of the dealt cards are made visually recognizable by other players by display of the cards on display device 42, this invention is not limited thereto and the display device 42 may be omitted without departing the concept of the present invention.

Figure 4B:
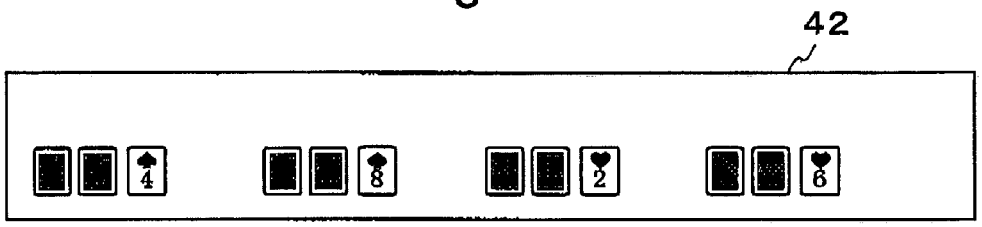
FIG. 4B is a schematic view showing a screen display of a card dealing display device of the gaming machine according to an embodiment of the present invention.
Figure 4C:
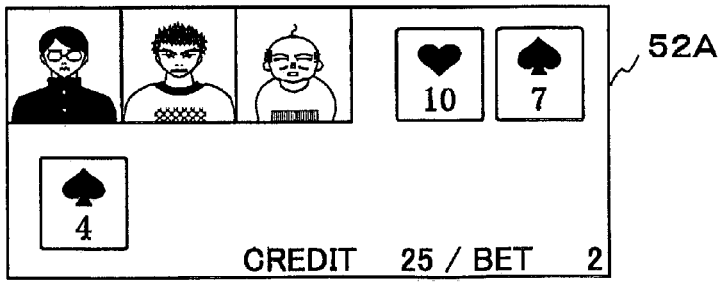
FIG. 4C is a schematic view showing a screen display of an individual display device of the gaming machine according to an embodiment of the present invention.

Furthermore, individual player display devices 52 (52A to 52D), each of which can be recognized visually by a player, is equipped in front of the casing 12, and each of these displays all of the cards, which have been dealt to the corresponding, player from the dealer image, in an up-facing manner (see FIG. 4C). Each player is thus enabled so that only he/she can visually recognize the contents of his/her hand. The number of medals bet by each player, the number of medals credited to each player, and taken images of the other players, etc., are displayed as well (see FIG. 4C).

The parts of the above-described display devices 32, 42, and 52 (52A to 52D), which display the effect images to be described below, may be arranged from liquid crystal display panels, cathode ray tubes, etc. Also, though with the above-described embodiment, display devices 32, 42, and 52 (52A to 52D) are indicated as being provided in casing 12 of gaming machine 10, display devices 32, 42, and 52 (52A to 52D) may be disposed at any position of the gaming machine as long as the players can see the display devices.

Also though with gaming machine 10 of this embodiment, display devices 52 (52A to 52D) are disposed side-by-side with respect to display device 32, this invention is not limited thereto, and display devices 52 (52A to 52D) may be arranged in a substantially semi-circular shape centered about the center of display device 32.

Furthermore, various operation switches are equipped near each display device 52 (52A to 52D). As shown in FIG. 1, these operation switches include an entry switch 20 (20A to 20D), a bet/raise switch 24 (24A to 24D), a call switch 26 (26A to 26D), a hold switch 30 (30A to 30D), and a disbursement switch 31 (31A to 31D). A player operates these switches to make the game progress.

Here, "raise" refers to the increasing of the amount of medals bet by a player, "call" refers to the betting by a player of an amount equal to a raise by another player, and "hold" refers to the quitting of a game in such a case as when a player cannot make a call and has judged that he/she cannot win. A game proceeds by all players betting equal amounts of medals.

Though in regard to the above-mentioned operations switches, the present embodiment includes entry switch 20 (20A to 20D), bet/raise switch 24 (24A to 24D), call switch 26 (26A to 26D), hold switch 30 (30A to 30D), and disbursement switch 31 (31A to 31D) as shown in FIG. 1, this invention is not limited thereto and other switches may be provided, and furthermore, the switches do not have to be those that are operable by pressing but may be operating members that are operable by rotation, etc.

Also, though with this embodiment, the respective operation switches mentioned above are arranged as switches that are operable by pressing, this invention is not limited thereto, and the respective switches mentioned above may be arranged as virtual switches that are displayed as images on the respective individual player display devices 52 (52A to 52D) and use touch sensors, etc, with which switch operations are performed by a player touching the respective switches displayed as images.

Also, a medal slot 49 (49A to 49D) is equipped near the above-mentioned operation switches, and the number of medals loaded from medal slot 49 (49A to 49D) is counted by a medal detection sensor 22 (22A to 22D) (see FIG. 2) equipped inside medal slot 49 (49A to 49D). The number of medals counted is displayed as credit on display device 52 (52A to 52D).

An image taking device 44 (44A to 44D) is equipped in front of each display device 52 (52A to 52D) and this takes the image of the expression of the corresponding player and makes the taken image be displayed on display devices 52 (52A to 52D) (see FIG. 4C). An example of the image taking device 44 may be a camera. A player is thus enabled to play a game while visually recognizing the expressions of other players and the possibility of enjoying the tactical interaction among players, etc., is thus increased.

Yet furthermore, portable terminal device connection connectors 48 (48A to 48D), enabling connection with a portable telephone (or cellular phone) or other portable terminal device, are equipped at lower parts of the side face of casing 12, and by connecting a portable telephone or other portable terminal device to a portable terminal device connection connector 48 (48A to 48D), not only can chatting with other players be enjoyed but the possibility of enjoying the tactical interaction among players is also increased. The portable terminal device connection connector may be referred to "portable terminal connector" herein after.

Furthermore, medal ejection slots 50 (50A to 50D) are equipped at lower parts of the side face of casing 12, and from these are ejected medals disbursed by disbursement devices 54 (54A to 54D) (see FIG. 2), each of which is installed inside a medal ejection slot 50 (50A to 50D) and includes a hopper, hopper drive circuit, etc. This "disbursement device 54 (54A to 54D)" corresponds to making up a part of a "benefit provision means" as described in the claims.

[Arrangement of the Control Part of the Gaming Machine]

Figure 2:
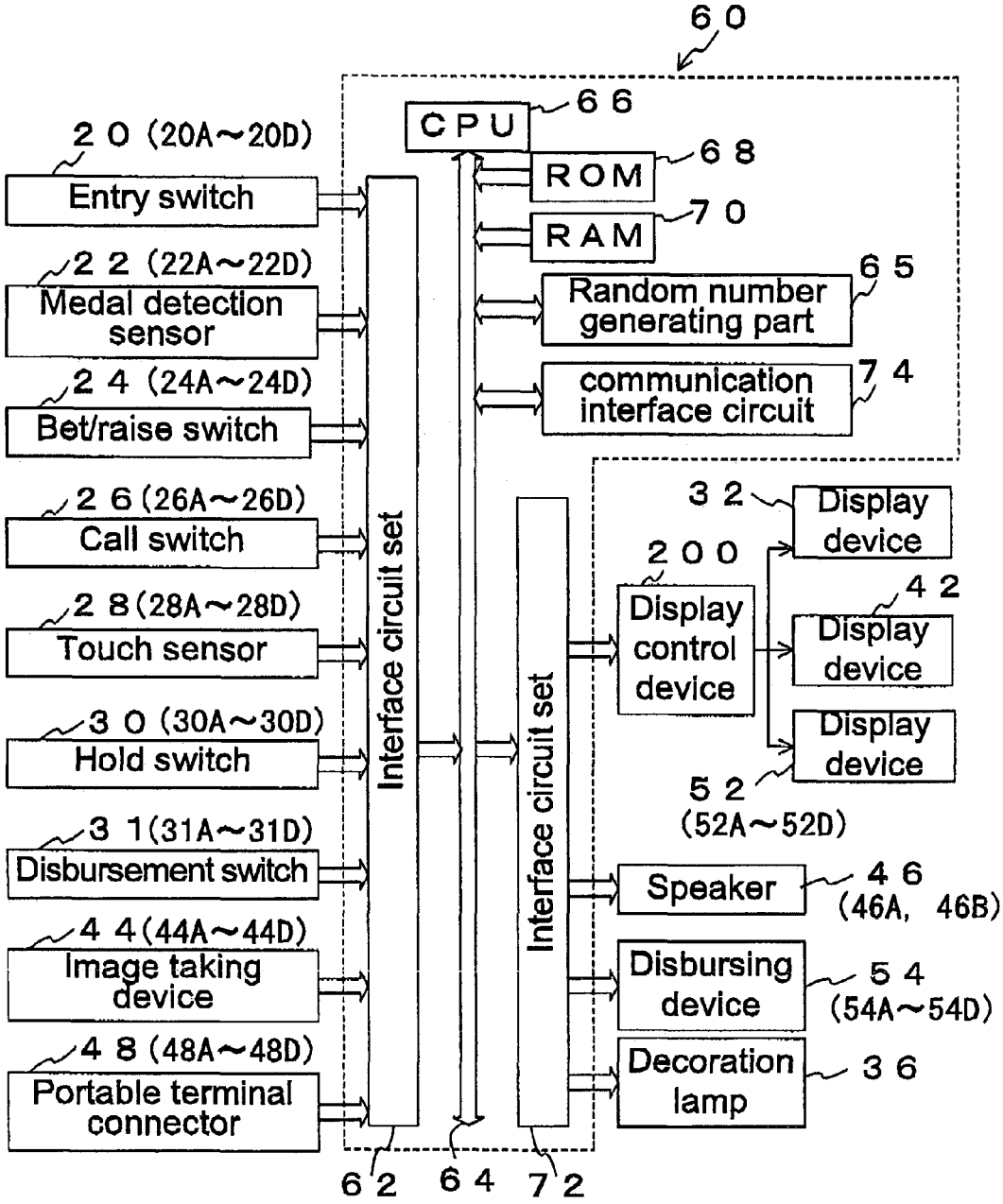
FIG. 2 is a block diagram showing a main control circuit of the gaming machine according to an embodiment of the present invention.

FIG. 2 shows a block diagram of a control circuit of a gaming machine according to this embodiment of the present invention.

A main control circuit 60 includes a CPU 66, which performs control operations based on a program set in advance, and ROM 68 and RAM 70, which are storage means.

As described below, a main control circuit 60 is equipped with interface circuit sets 62 and 72, an input/output bus 64, a random number generating part 65, and a communication interface circuit 74.

Input and output of data signals or address signals to and from a central processing unit (referred to hereinafter as "CPU") 66 is performed via input/output bus 64, and a timer (not shown), to be described below, is equipped inside CPU 66.

"CPU 66" may refer to a part of or the entire of "game control means," "benefit provision means," "rank determination means," and "win/loss determination means" as described in the claims.

The above-mentioned ROM 68 records a control program that controls the flow of the entirety of the game of the gaming machine. ROM 68 furthermore stores initial data for executing control programs, a program for controlling a game of virtual players, a program for controlling the win/loss determination in a game, a program for controlling the disbursement of medals or the addition/subtraction of credit, a program that performs display control of display device 32, etc.

Specifically, the following programs are included among the programs in the present embodiment.

(A) A program that makes a computer execute a rank determination step of making ranks determined in accordance with the results of the above-mentioned game.

(B) A program that makes a computer execute a win/loss determination step of making a plurality of players to be provided with benefits determined so as to comprise a combination of the player with the highest rank as determined in the above-mentioned rank determination step and players of ranks that are not in the order of results starting with the highest rank.

Also in regard to the step described in (B), a program is also included that makes a computer execute the determining of the above-mentioned plurality of players to be provided with benefits so that the above-mentioned plurality of players to be provided with benefits includes the player with the lowest rank as determined in the above-mentioned rank determination step.

"ROM 68" may refer to a part of or the entire of "game control means," "benefit provision means," "rank determination means," and "win/loss determination means" as described in the claims.

By making the above-described program be executed, benefits can be provided, as a result of the game, to the player with the highest rank as well as to players whose ranks are not in the order of ranks starting from the highest rank.

Though normally in the process of playing a game, a player, who comes to predict that his/her rank will not be the highest and the provision of benefit cannot be expected, may lose the motivation to continue to play the game and give up, with this invention, since arrangements are made to provide benefits not only to the player with the highest rank but also to players whose ranks are not in the order of ranks starting from the highest rank and a player is thus left with the possibility of being provided with benefit until the game is finally ended even if his/her rank is not the highest, a situation, where all players participating in the game lose the motivation to continue to play the game, is prevented and the possibility that the game can be enjoyed to the end is increased.

Furthermore, such a program may be readable by a computer and may be stored in a storage medium of a gaming machine itself or a server, etc. Yet furthermore, such a program may be stored in a storage medium incorporated in an equipment of another arrangement or may be stored in a divided manner in storage media incorporated in a gaming-machine and a server.

Yet furthermore, though the programs in this embodiment are recorded in ROM 68, they may be recorded in a hard disk device, CD-ROM, DVD, or other storage medium instead. These programs do not have to be recorded in advance and may be recorded in RAM 70, etc., after the power is turned on. Furthermore, each of the programs may be recorded in a separate storage medium.

The above-mentioned RAM 70 stores the values of flags and variables used in the above-described programs.

Specifically, an entry flag, end-of-game flag, winner flag, dealt card data, winning combination data, etc., which will be described below, are stored.

"RAM 70" may refer to a part of or the entire of "game control means," "benefit provision means," "rank determination means," and "win/loss determination means" as described in the claims.

Each of the above-mentioned entry switches 20 (20A to 20D) is connected to interface circuit set 62, and when pressed by the operation of a player, supplies an entry signal to interface circuit set 62. Upon receiving the entry signal, interface circuit set 62 converts the entry signal into entry data of predetermined form and supplies the entry data to CPU 66 via input/output bus 64.

Each of the above-mentioned disbursement switches 31 (31A to 31D) is also connected to interface circuit set 62, and when pressed by the operation of a player, supplies a disbursement signal to interface circuit set 62, and upon receiving the disbursement signal, interface circuit set 62 converts the disbursement signal into disbursement data of predetermined form and supplies the disbursement data to CPU 66 via input/output bus 64.

Furthermore, each of the above-mentioned bet/raise switches 24 (24A to 24D) is also connected to interface circuit set 62, and when pressed by the operation of a player, supplies abet/raise signal to interface circuit set 62, and upon receiving the bet/raise signal, interface circuit set 62 converts the bet/raise signal into bet/raise data of predetermined form and supplies the bet/raise data to CPU 66 via input/output bus 64.

Yet furthermore, each of the above-mentioned medal detection sensors 22 (22A to 22D) is also connected to interface circuit set 62, and when a medal loaded from medal slot 49 (49A to 49D) by a player is detected, supplies a loading detection signal to interface circuit set 62, and upon receiving the loading detection signal, interface circuit set 62 converts the loading detection signal into loading detection data of predetermined form and supplies the loading detection data to CPU 66 via input/output bus 64.

Yet furthermore, each of the above-mentioned touch sensors 28 (28A to 28D) is also connected to interface circuit set 62, and when touched by a hand of a player, supplies a touch detection signal, which indicates the location of the touch, to interface circuit set 62, and upon receiving the touch detection signal, interface circuit set 62 converts the touch detection signal into touch detection data of predetermined form and supplies the touch detection data to CPU 66 via input/output bus 64.

Yet furthermore, each of the above-mentioned hold switches 30 (30A to 30D) is also connected to interface circuit set 62, and when pressed by the operation of a player, supplies a hold Signal to interface circuit set 62, and upon receiving the hold signal, interface circuit set 62 converts the hold signal into hold data of predetermined form and supplies the hold data to CPU 66 via input/output bus 64.

Yet furthermore, each of the above-mentioned call switches 26 (26A to 26D) is also connected to interface circuit set 62, and when pressed by the operation of a player, supplies a call signal, indicating a card to be exchanged, to interface circuit set 62, and upon receiving the call signal, interface circuit set 62 converts the call signal into hold data of predetermined form and supplies the call data to CPU 66 via input/output bus 64.

Yet furthermore, each of the above-mentioned image taking devices 44 (44A to 44D) is also connected to interface circuit set 62, and constantly supplies image signals to interface circuit set 62 while the power is turned on, and upon receiving the image signals, interface circuit set 62 converts the image signals into image data of predetermined form and supplies the image data to CPU 66 via input/output bus 64.

Yet furthermore, each of the above-mentioned portable terminal connectors 48 (48A to 48D) is connected to interface circuit set 62, and by connecting a portable telephone or other portable terminal device to a portable terminal connector 48 (48A to 48D), a player can enjoy chatting with other players and enjoy tactical Interactions among players. Each portable terminal connector 48 (48A to 480) constantly supplies character communication signals to interface circuit set 62 while a portable terminal device is connected, and upon receiving the character communication signals, interface circuit set 62 converts the character communication signals into character communication data of predetermined form and supplies the character communication data to CPU 66 via input/output bus 64.

Yet furthermore, the above-mentioned random number generating part 65 is connected to input/output bus 64 and supplies the generated random numbers to CPU 66 via input/output bus 64. When an instruction for generating a random number is issued from CPU 66 to random number generating part 65, random number generating part 65 generates a random number within a predetermined range and supplies a signal indicating the value of this random number via input/output bus 64 to CPU 66. CPU 66 determines the condition of progress of the game from this generated random number.

Though gaming machine 10 of the present embodiment is equipped with a random number generating part 65 that generates random numbers, this invention is not limited thereto, and CPU 66 itself may be arranged to generate random numbers instead of providing random number generating part 65 in particular, or random number generating part 65 may be equipped and CPU 66 may be arranged to generate internal lottery data based on the random numbers generated by random number generating part 65.

Yet furthermore, communication interface circuit 74 is connected to input/output bus 64, and as shall be described below, is provided for performing communication with a server 80, etc., via a public telephone line network, local area network (LAN), or other communication line.

Yet furthermore, an interface circuit set 72 is also connected to input/output bus 64. Speakers 46 (46A and 46B), decoration lamp 36, and disbursement devices 54 (54A to 54D) are connected to interface circuit set 72, and interface circuit set 72 supplies drive signals, drive power, and various signals to control each of the above-mentioned devices in accordance with the results of computational processes performed at CPU 66.

Yet furthermore, display control device 200 is also connected to interface circuit set 72, and based on an image display instruction generated from main control circuit 60, display control device 200 generates drive signals for driving the display devices 32, 42, and 52 (52A to 52D) connected to display control device 200.

Though gaming machine 10 of this embodiment is arranged to be equipped with display control device 200, this invention is not limited thereto, and there is no problem with an arrangement, wherein display control device 200 is not equipped and CPU 66, etc., are made to perform all image display processes.

[Arrangement of the Display Control Device of the Gaming Machine]

Figure 3:
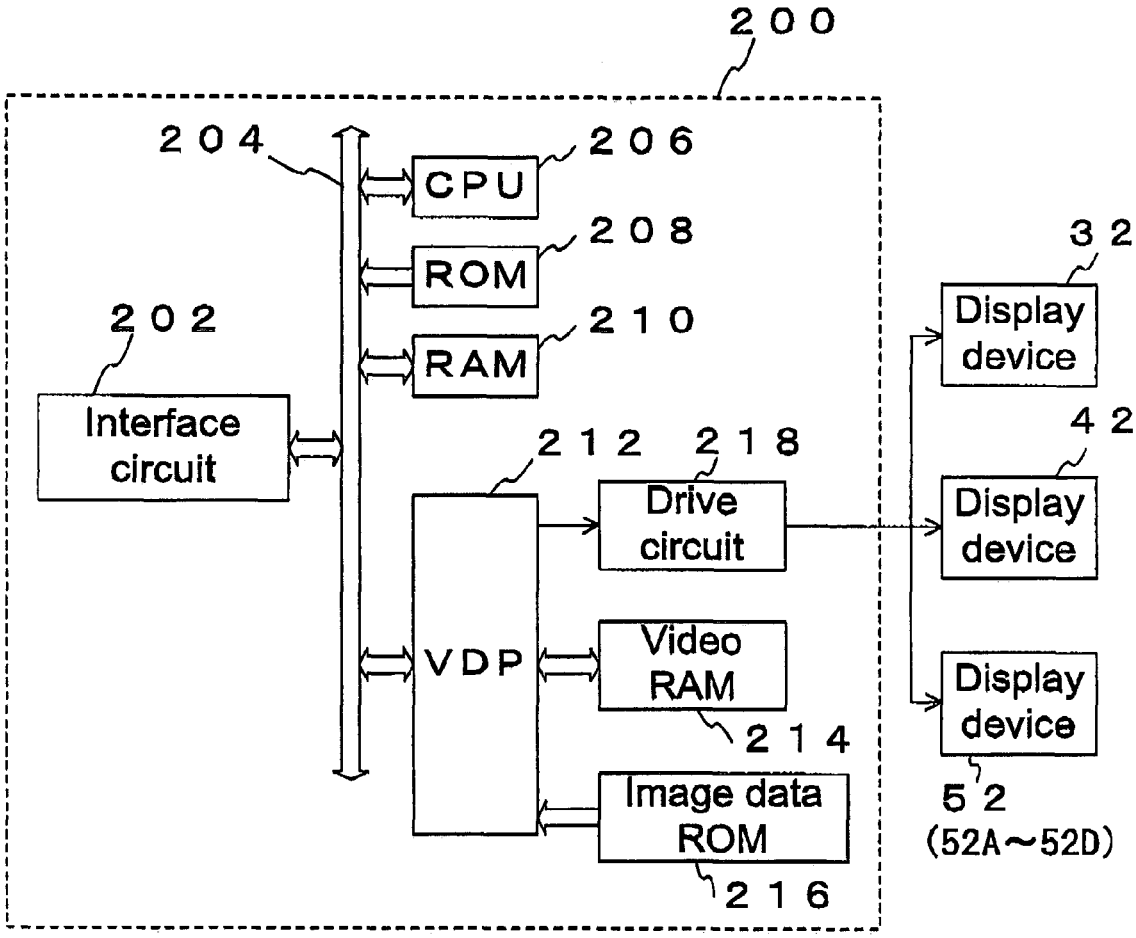
FIG. 3 is a block diagram showing a display control device of the gaming machine according to an embodiment of the present invention.

FIG. 3 shows a block diagram showing the circuit of the above-mentioned display control device 200.

An interface circuit 202 is connected to an input/output bus 204, and an image display instruction generated from the above-mentioned main control circuit 60 is supplied via interface circuit 202 to input/output bus 204. Input/output bus 204 is arranged to input and output data signals or address signals to and from a central processing unit (referred to hereinafter as "CPU") 206.

A ROM (read only memory) 208 and a RAM (random access memory) 210 are also connected to the above-mentioned input/output bus 204. ROM 208 stores a display control program for generating drive signals to be supplied to display device 32 based on image display instructions generated from main control circuit 60. Meanwhile, RAM 210 stores the values of the flags and variables used in the above-mentioned program.

Furthermore, an image data processor (referred to hereinafter as "VDP") 212 is also connected to input/output bus 204. This VDP 212 includes a so-called sprite circuit, a screen circuit, and a palette circuit, and is a processing device that can perform various processes for making display device 32 display images.

Yet furthermore, to the above-mentioned VDP 212 are connected a video RAM 214, for storing image data in accordance with image display instructions generated from main control circuit 60, and an image data ROM 216, for storing background image data, card image data, character image data, and other image data. A drive circuit 218, which generates drive signals for driving display device 32, is also connected to VDP 212.

Yet furthermore, by reading and executing the display control program stored in ROM 208, the above-mentioned CPU 206 stores, in video RAM 214, the image data to be displayed on display device 32 in accordance with image display instructions generated from main circuit 60. The image display instructions generated from main control circuit 60 include a player display instruction, background display instruction, card display instruction, character figure display instruction, and other display instructions.

Yet furthermore as mentioned above, image data ROM 216 stores card image data, character figure image data of animated objects and other character figures displayed for an effect screen, background image data, which make up the backgrounds of display devices 32, 42, and 52 (52A to 52D), and other image data.

Yet furthermore, the above-mentioned design image data are used to perform a change or stop of the design displays on display device 32, 42, and 52 (52A to 52D), and include image data corresponding to a variety of display modes, for example, magnified images, reduced images, deformed images, etc. The above-mentioned character figure image data include image data necessary for displaying modes in which a character figure performs a series of operations.

[Operation of the Gaming Machine]

Gaming machine 10 of the present embodiment is mainly for performing a poker game called "7-Card-Stud." In this poker game, the dealer deals seven cards to each player, and the superiority with respect to other players is competed with a combination of five cards selected arbitrarily from among the seven dealt cards.

Though with the embodiment described below, a case where this invention is applied to a gaming machine for performing a poker game of 7-Card-Stud shall be described as a preferred embodiment of this invention's gaming machine, this invention may be applied not only to 7-Card-Stud but also to an ordinary poker game in which five cards are dealt and a winning combination is formed by exchanging cards several times.

Figure 6:
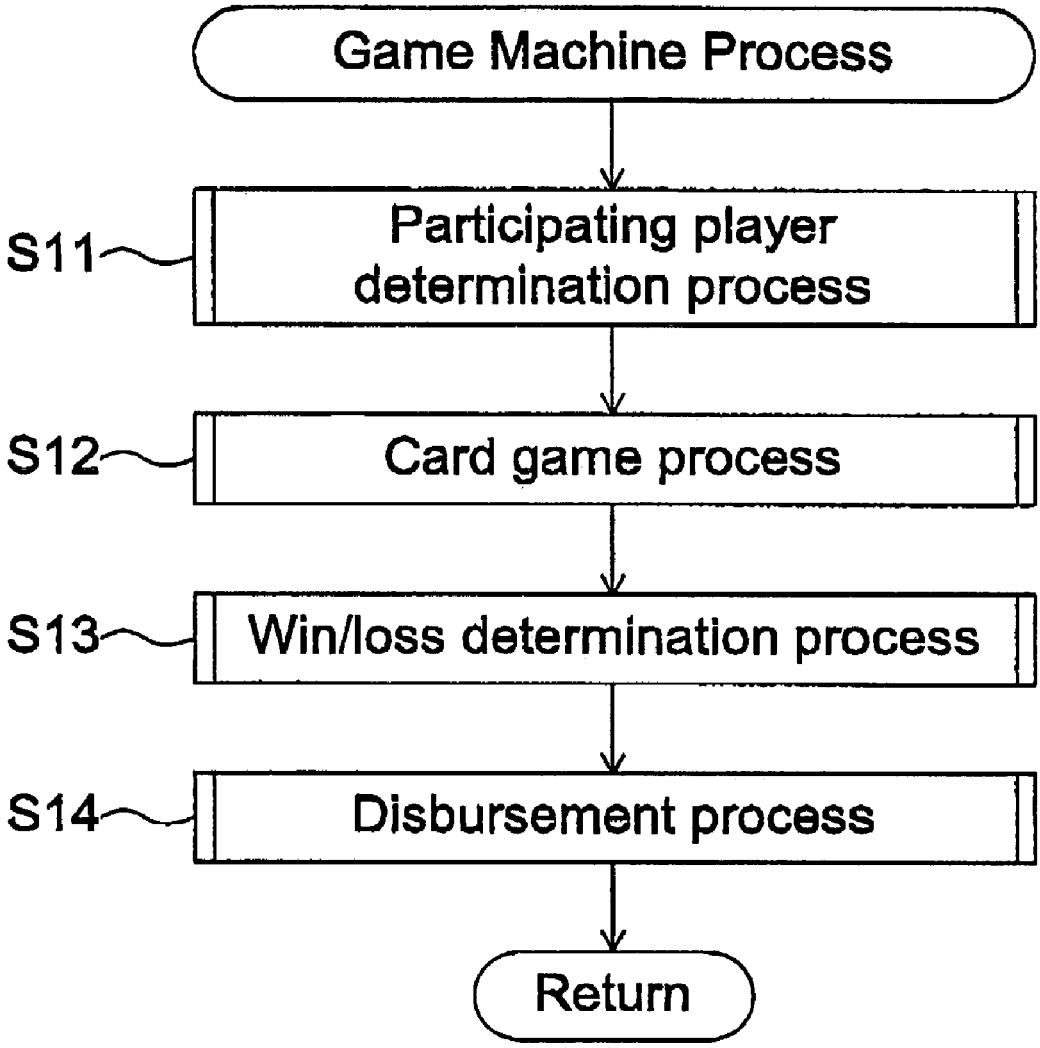
FIG. 6 is a flowchart showing a game machine process executed in a gaming machine according to an embodiment of the present invention.
Figure 7:
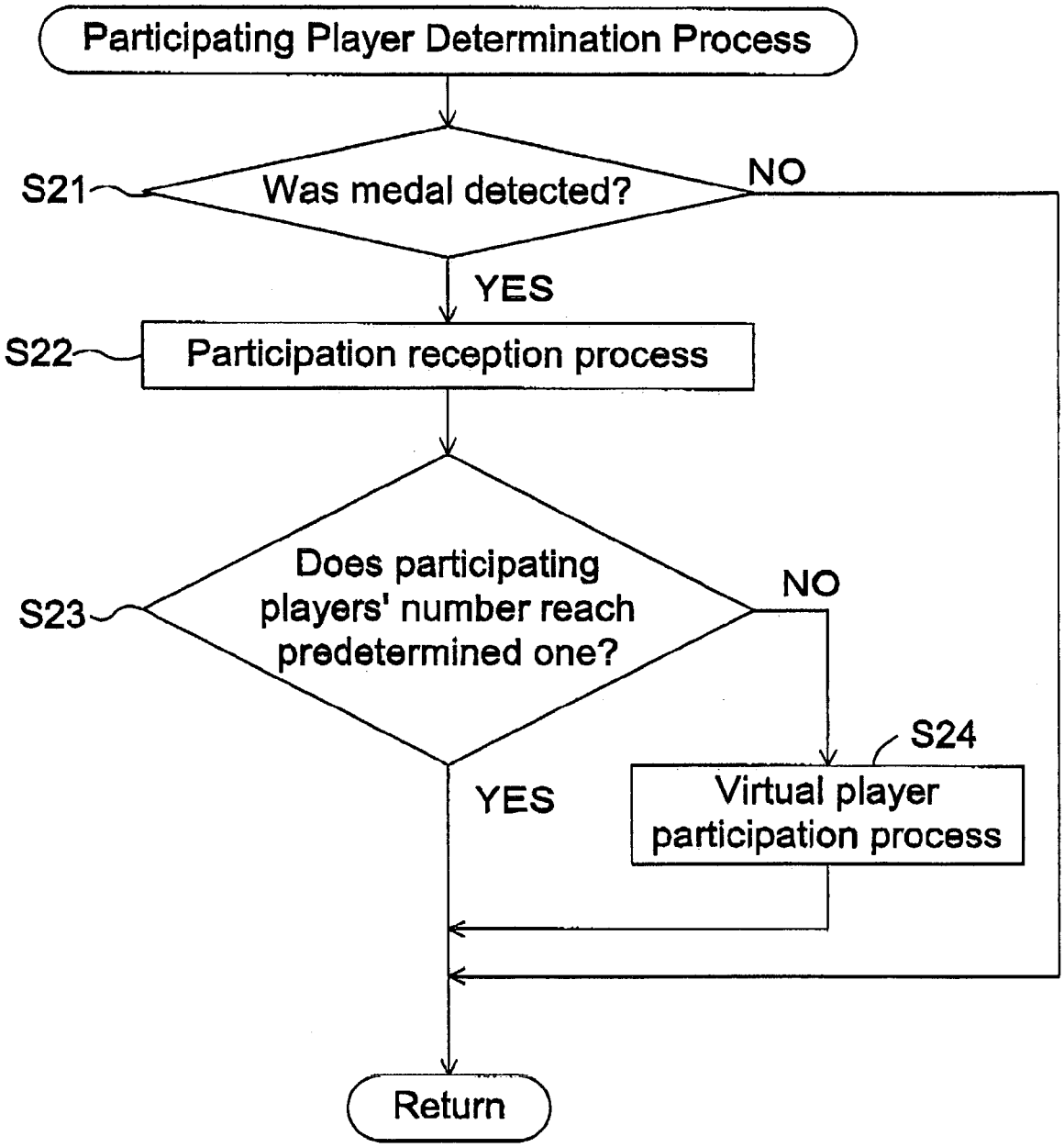
FIG. 7 is a flowchart showing a participating player determination process executed in a gaming machine according to an embodiment of the present invention.
Figure 8:
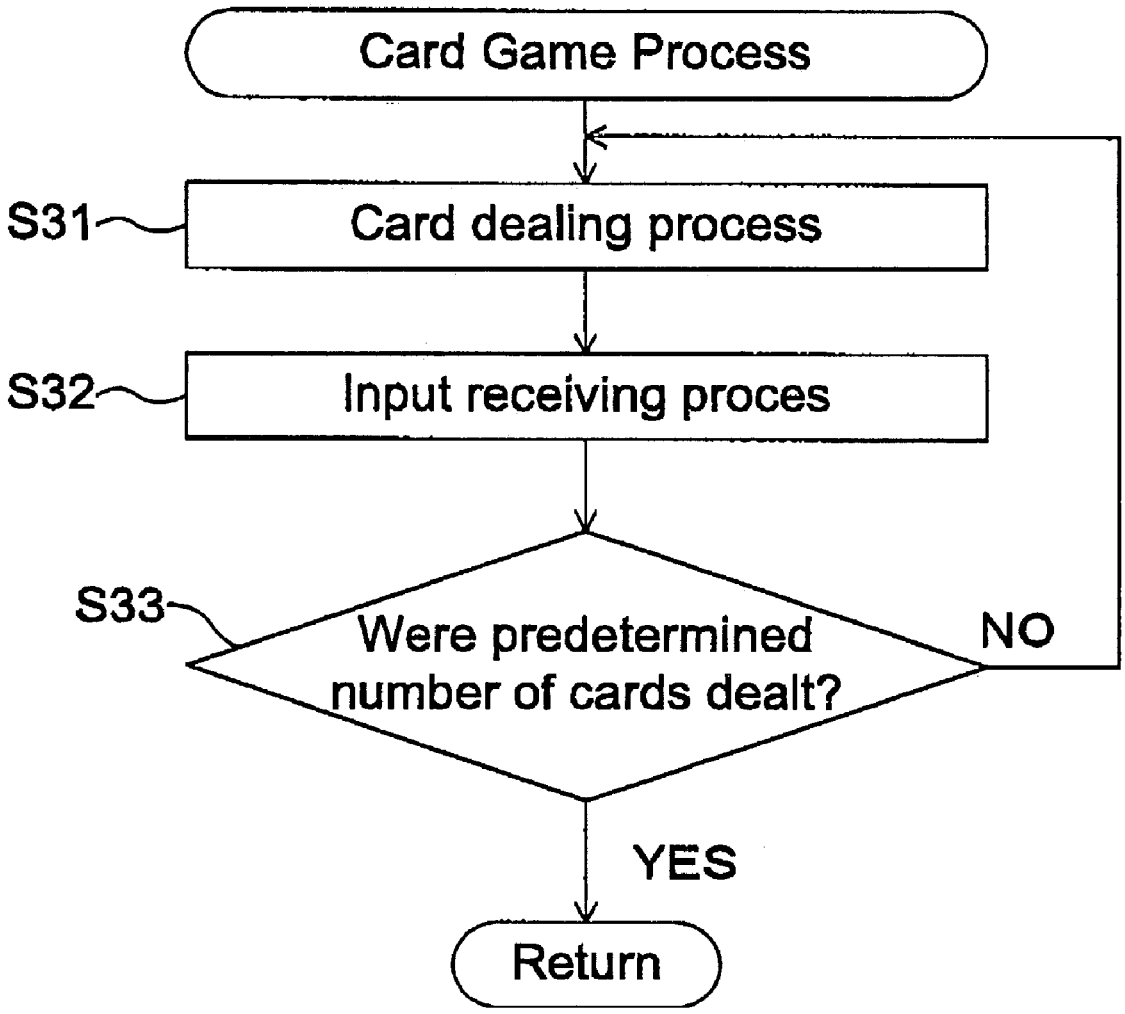
FIG. 8 is a flowchart showing a card game process executed in a gaming machine according to an embodiment of the present invention.
Figure 9:
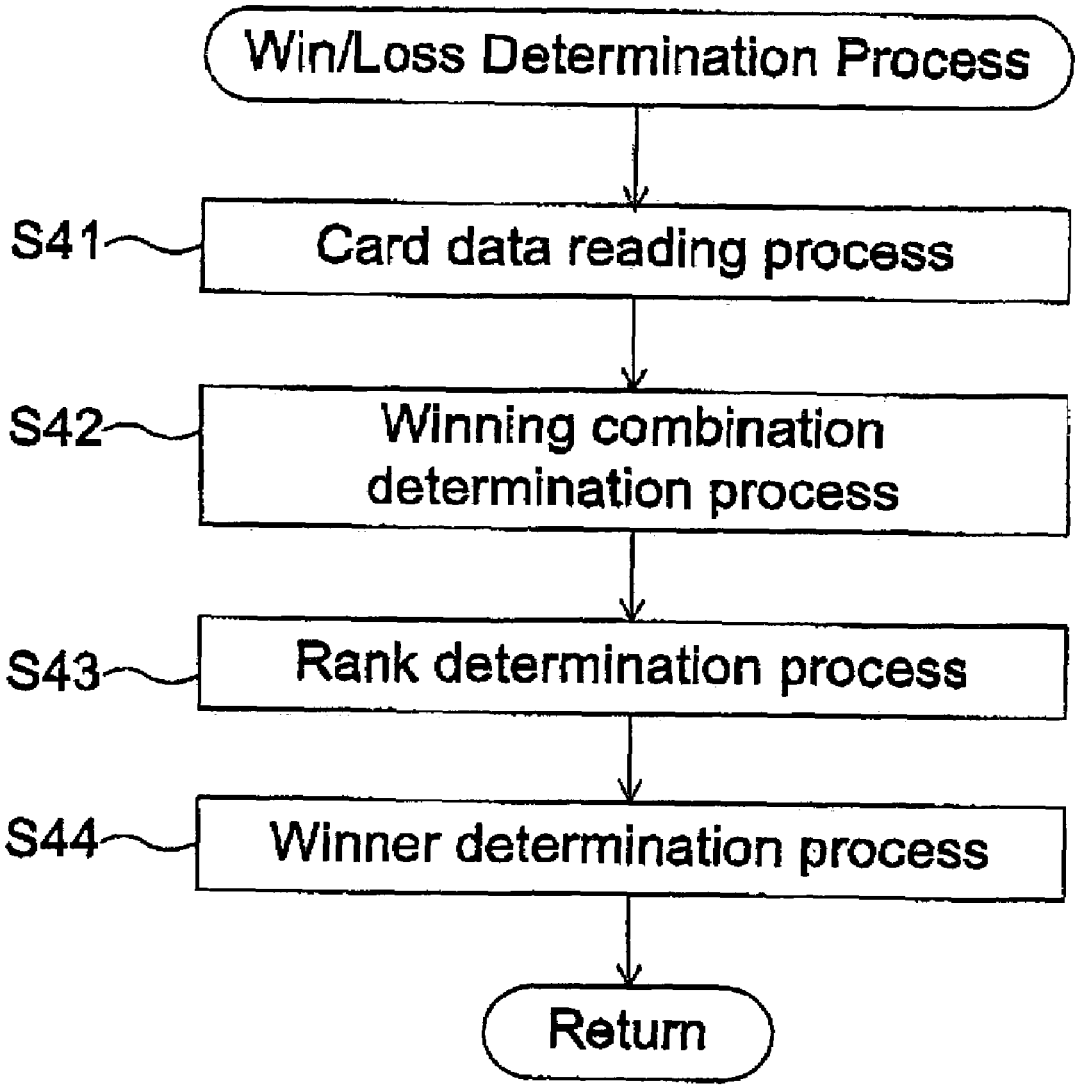
FIG. 9 is a flowchart showing a win/loss determination process executed in a gaming machine according to an embodiment of the present invention.

Subroutines for controlling gaming machine 10, which are executed by the above-described main control circuit 60, are shown in FIGS. 6 through 11. The subroutine shown in FIG. 6 is called and executed at a predetermined timing from a main program of gaming machine 10 that is executed in advance.

In the following, the gaming machine 10 is started beforehand, and the variables used in the above-described CPU 66 are initialized to predetermined values such that the gaming machine 10 is in steady-state operation, In the subroutine shown in FIG. 6, first, a participating player determination process is executed (step S11). As described later, in this process, CPU 66 determines the participating players in accordance with entry data supplied from entry switches 20 (20A to 20D). If the number of participating players does not reach a predetermined number, a process that makes virtual players participate is performed. When this process is ended, a transfer to step S12 is performed.

A card game process is then executed (step S12). As described layer, in this process, CPU 66 sends an image display instruction to display control device 200 in accordance with dealt card data that have been determined by the lottery results of an internal lottery and thereby makes display device 42 and display devices 52 (52A to 52D) display images of the dealt cards that are to be dealt to the players. Also, the numbers of bet medals are determined according to the respective data supplied from bet/raise switches 24 (24A to 24D) or call switches 26 (26A to 26D) by the operations of the players. Furthermore, in accordance with hold data supplied from a hold switch 30 (30A to 30D) upon operation by a player, the ending of the game for the player who performed the operation is determined. When this process is ended, a transfer to step S13 is performed.

Next, a win/loss determination process is executed (step S13). As described later, in this process, CPU 66 reads the data, which are recorded in RAM 70 and concern the seven dealt cards that have been dealt to the respective players, collates the data with winning combination data recorded in ROM 68, and determines win or loss in accordance with this collation result. When this process is ended, a transfer to step S14 is performed.

Next, a disbursement process is executed (step S14). As described later, in this process, CPU 66 performs the disbursement of medals or the addition of credits that corresponds to the disbursement of medals to a player who has become a winner in accordance with bet amount data recorded in RAM 70. When this process is ended, this subroutine is ended immediately.

[Participating Player Determination Process]

In the participating player determination routine that is called in step S11 as described above, the subroutine shown in FIG. 7 is called. First, whether or not a medal has been detected is judged (step S21). Upon detecting a medal loaded from medal slot 49 (49A to 49D) by a player, medal detection sensor 22 (22A to 22D) supplies a loading detection signal to interface circuit set 62, and upon receiving the loading detection signal, interface circuit set 62 converts the loading detection signal into loading detection data of predetermined form and supplies the loading detection data to CPU 66 via input/output bus 64. If in this process, CPU 66 judges that the above-mentioned loading detection data has been supplied, a transfer to step S22 is performed while if it is judged that the above-mentioned loading detection data has not been supplied, this subroutine is ended immediately.

A participation reception process is then executed (step S22). In this process, CPU 66 starts the measurement of time by means of the timer (not shown) incorporated in CPU 66 and records an elapsed time data in RM 70 at predetermined timings.

Also as mentioned above, CPU 66 judges whether or not entry data have been supplied from entry switches 20 (20A to 20D) in accordance with the pressing of the operation switches by the players. Upon judging that an entry data has been supplied from an entry switch 20 (20A to 20D), CPU 66 reads a player data table, positioned in RAM 70 as shown in FIG. 12, in accordance with data identifying the entry switch 20 (20A to 20D) that is indicated by the entry data and records "1" in an entry flag (A) in the player data table that has been read. For example, if it is judged that entry data has been supplied from entry switch 20A, CPU 66 reads the player data table positioned in RAM 70 and records "1" in the entry flag (A) of the area of P1.

Furthermore, in order to count the number of participating players, CPU 66 adds "1" to an entry count data (not shown), recorded in RAM 70, and records the data resulting from the addition in RAM 70.

Yet furthermore, CPU 66 performs the above-described participation reception process until the predetermined time elapses. For example, if the reception time is 20 seconds, CPU 66 judges whether or not the elapsed time data, recorded in RAM 70 at predetermined timings in accordance with the timer (not shown) incorporated in CPU 66, is data indicating 20 seconds. If CPU 66 judges that the data indicates 20 seconds, it ends the participation reception process immediately, while if the data is not judged as indicating 20 seconds, the participation reception process is continued until the data is judged as indicating 20 seconds.

Yet furthermore, even if CPU 66 has judged that the predetermined time has elapsed, in other words, that the above-mentioned elapsed time data is data indicating 20 seconds, if it is judged that entry switches 20 (20A to 20D) have not been pressed by any player and the entry count data recorded in RAM 70 is data indicating "0," time measurement by the timer (not shown) incorporated in CPU 66 is started again and the elapsed time data is recorded in RAM 70 at predetermined timings so as to extend the entry time by another 20 seconds. When this process is ended, a transfer to step S23 is performed.

Next, whether or not the number of participants has reached the predetermined number is judged (step 23). For example, if the predetermined number of participants is set to four, CPU 66 reads the entry count data recorded in RAM 70 in order to count the number of participants in the above-described step S22 and judges whether or not the data that has been read is data indicating "4." If CPU 66 judges that the entry count data is not data indicating "4," in other words, that the data indicates "1," "2," or "3," a transfer to step S24 is performed while if the entry count data is judged to be data indicating "4," the present subroutine is ended immediately.

A virtual player participation process is then performed (step S24). CPU 66 reads the entry count data recorded in RAM 70 in the above-described step S22 and, in accordance with the read entry count data, determines the virtual players corresponding to the insufficiency in the number of participants by an internal lottery. For example, if the read entry count data is data indicating "1," determination of three virtual players is performed, If the read entry count data is data indicating "2," determination of two virtual players is performed. Furthermore, if the read entry count data is data indicating "3," determination of one virtual player is performed. A "virtual player" is a concept that is in a corresponding relationship with a "(real) player" and specifically indicates a virtual player that is generated by CPU 66 of gaming machine 10. This invention's gaming machine prepares a plurality of such virtual players, and when the number of players is insufficient, selects, from among these virtual players, players corresponding to the insufficiency in the number of players by lottery.

CPU 66 issues a signal for generating a random number to random number generating part 65 and upon receiving this signal, random number generating part 65 generates a random number of a predetermined range and supplies a signal indicating the value of this random number to CPU 66. In accordance with this generated random number, CPU 66 determines the virtual player that is to participate in the game from among the data of virtual players of different personalities that are stored in ROM 68. The possibility for a player to enjoy tactical interaction, etc., in the same manner as when there are other players is thus increased. When this process is ended, the present subroutine is ended immediately.

Though with the present embodiment, when the number of participating players does not reach a predetermined number, virtual players are made to participate so as to make up for the insufficiency, this invention is not limited thereto, and virtual players may be made to participate even if the number of participating players reach the predetermined number of players. By doing so, control can be performed so that when the bet amount is low, a virtual player can be made to bet ahead of the other players, etc., that is, a virtual player can be made to play a leading role in the game, thus providing changes in the flow of the game.

Also, though with gaming machine 10 of this embodiment, the number of players playing the game, including virtual players, was set to four, this invention is not limited thereto, and the number of players may be any number as long as there are three or more players.

[Card Game Process]

In the card game process routine that is called in step S12 as described above, the subroutine shown in FIG. 8 is called. With the poker game of the present embodiment a total of seven cards is dealt to each player, and five of these seven cards are selected arbitrarily to form a winning combination.

In the first round of card dealing upon starting of the game, three cards are dealt to each player (see FIGS. 4A-4C) Thereafter, in each round from the second round to the fifth round, one card is dealt to each player so that a total of seven cards (see FIG. 5) are dealt in the final stage.

First, a card dealing process is performed (step S31). In this process, CPU 66 issues a signal for generating a random number to random number generating part 65 in order to determine cards to be dealt to the players by lottery and upon receiving this signal, random number generating part 65 generates a random number of a predetermined range and supplies a signal indicating the value of this random number to CPU 66. In accordance with this generated random number, CPU 66 reads a card data table (not shown) stored in ROM 68 and determines the card to be dealt. This card data is a two-digit hexadecimal data and indicates the type of dealt card that is determined in accordance with the above-mentioned lottery result.

Specifically, when a card indicating the "ace of hearts" is to be dealt, the data, "31," is recorded. That is, the second digit indicates the type of card, such as "spades," "clubs," etc., and is "1" when the card to be dealt is "spades," "2" when the card to be dealt is "clubs," "3" when the card to be dealt is "hearts," and "4" when the card to be dealt is "diamonds." Furthermore, the first digit indicates the numeral of the card to be dealt, and when the numeral of the card is any of "1" to "9," the numerical value is used as it is, when the numeral of the card is "10," "A" is indicated, when the numeral of the card is "J (11)," "B" is indicated, when the numeral of the card is "Q (12)," "C" is indicated, and when the numeral of the card is "K (13)," "D" is indicated.

Also, CPU 66 records the dealt card data, determined in accordance with the above-mentioned lottery results and dealt to each player, in RAM 70. CPU 66 reads the player data table (see FIG. 12) and records the dealt card data, determined according to the above-mentioned lottery results, in the positions of C1 to C7 of the read player data table. In the first round of card dealing, dealt card data are recorded in the positions of C1 to C3, and thereafter, the dealt card data is recorded in an accumulating manner, in each of C4 to C7 on each round of card dealing.

Seven dealt card data are thus recorded in an accumulating manner in RAM 70 for each player in a game in which four players participate (see C1 to C7 of FIG. 12), and as long as there are no players who hold (quit the game) in the middle, a total of 28 data are recorded for the four players.

Yet furthermore CPU 66 sends image display instructions to display control device 20 in accordance with the above-mentioned card data and makes images of the dealt cards be displayed on display device 42 and display devices 52 (52A to 52D).

On display device 42, of the three cards dealt in the first round, two of the dealt cards are displayed in a down-facing manner as shown in FIG. 4B. The third dealt card is displayed in an up-facing manner. All of the cards dealt in the second round onwards are also displayed in an up-facing manner. Yet furthermore, on each display device 52 (52A to 52D) all of the seven dealt cards that are dealt by the final stage are displayed in an up-facing manner as shown in FIG. 4C. When this process is ended, a transfer to step S32 is performed.

Next, an input receiving process is performed (step S32). When cards have been dealt to the respective players and the display of images of the dealt cards on the respective display devices 52 (52A to 52D) has been completed, operation of the various switches, such as bet/raise switch 24 (24A to 24D), call switch 26 (26A to 26D), and hold switch 30 (30A to 30D), is performed by each player and the input of game information is performed.

In this process, upon receiving data supplied from an above-mentioned switch via interface circuit set 62, CPU 66 records the received data as game information input data in RAM 70.

Specifically, upon receiving bet/raise data from a bet raise switch 24 (24A to 24D), CPU 66 records the number of medals, bet by the corresponding player and indicated by the data, as bet amount data (not shown) in RAM 70.

Also, upon receiving call data from a call switch 26 (26A to 26D), CPU 66 adds the number of medals equal to the number of medals bet by the raising of another player to the above-mentioned bet amount data and records the result in RAM 70.

Each time a bet/raise data or a call data is supplied in the above-described manner, CPU 66 stores the bet amount indicated by the data in an accumulating manner as bet amount data in RAM 70.

Furthermore, when hold data is received from a hold switch 30 (30A to D30D), CPU 66, in order to end the continuation of the game by the player who operated the hold switch 30 (30A to 30D), reads the player data table (see FIG. 12) recorded in RAM 70 and records "1" in the end-of-game flag (B) positioned in the read player data table. When this process is ended, a transfer to step S33 is performed.

Next, whether or not the number of cards dealt has become the predetermined number of cards (seven cards) is judged (step S33). In this process, CPU 66 judges whether or not dealt card data are recorded at the C7 positions of the player data table (see FIG. 12) recorded in RAM 70. If CPU 66 judges that dealt card data are recorded at the C7 positions of the player data table (see FIG. 12), the present subroutine is ended immediately while if it is judged that dealt card data are not recorded at the C7 positions of the player data table (see FIG. 12), a transfer to step S31 is performed.

Though with the card dealing described above, of the seven cards to be dealt to each player, three cards are dealt in the first round and one card is dealt on each round thereafter, this invention is not limited thereto, and three cards maybe dealt in the first round and two cards may be dealt on each round thereafter. By doing so, the number of times of input of game information by operation of a bet/raise switch 24 (24A to 24D) by a player is decreased and the duration of one game can be shortened. Also, dealing may be performed in any division of the number of cards as long as a total of seven cards are dealt.

[Win/Loss Determination Process]

In the win/loss determination process routine that is called in step S13 as described above, the subroutine shown in FIG. 9 is called. First, a card data reading process is performed (step S41). In this process, CPU 66 reads the dealt card data (C1 to C7) of the respective players (P1 to P4) that are positioned in the player data table (see FIG. 12). When this process is ended, a transfer to step S42 is performed.

Next, a winning combination determination process is performed (step S42). In this process, CPU 66 reads a winning combination determination table (see FIG. 13) recorded in ROM 68 and performs a process of collating the dealt card data of the respective players that were read in the above-described step S41 with the winning combination determination table that has been read. Also, for each of the players P1 to P4, CPU 66 forms combinations of five dealt card data among the seven dealt card data to determine the strongest winning combination and weakest winning combination and records the determination results as a strongest winning combination data (D) and weakest winning combination data (E) in the player data table (see FIG. 12) positioned in RAM 70.

Figure 5:
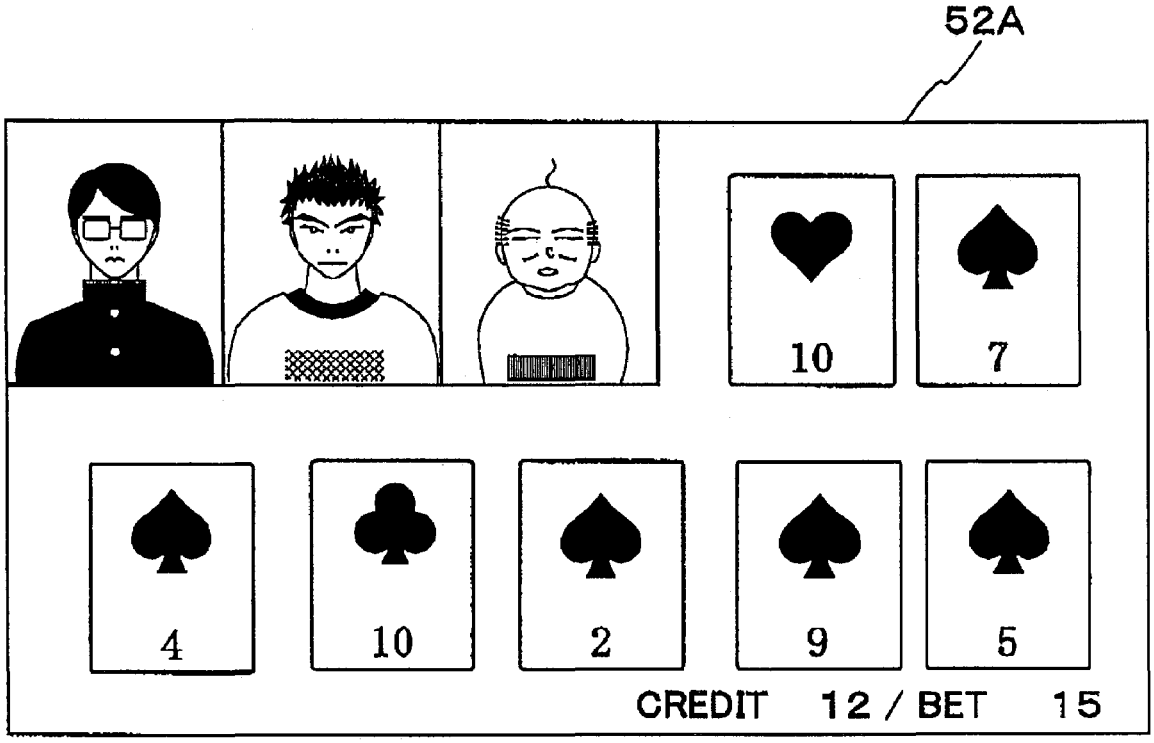
FIG. 5 is a schematic view showing a screen display of the gaming machine according to an embodiment of the present invention.

As an example, the determination of the winning combination in accordance with the dealt card data of player P1 shall be described using FIGS. 12 and 5. As shown in FIG. 5, the images of cards dealt to player P1 are displayed on display device 52 in accordance with the dealt card data (see C1 to C7 in FIG. 12) of player PI.

In this case, of the seven dealt card data (see C1 to C7 in FIG. 12) of player P1, the strongest winning combination that is formed is the "flush" that is formed by the combination of the seven of spades (the dealt card data "17" (C2)), the four of spades (the dealt card data "14" (C3)), the two of spades (the dealt card data "12" (C5)), the nine of spades (the dealt card data "19" (C6)), and the five of spades (the dealt card data "15" (C7)).

Meanwhile, the weakest winning combination that is formed is the "one pair" that is formed by the combination of the ten of hearts (the dealt card data "3A" (C1)) and the ten of clubs (the dealt card data "2A" (C4)).

In this case, based on the winning combination determination table (see FIG. 13) recorded in ROM 68, CPU 66 records "5," which is the winning combination rank data that indicates "flush," as the strongest winning combination data (D) in the player data table (see FIG. 12) positioned in RAM 70 and records "9," which is the winning combination rank data that indicates a "one pair, " as the weakest winning combination data (E) in the player data table (see FIG. 12) positioned in RAM 70. CPU 66 also performs the same process for each of players P2 to P4. When this process is ended, a transfer to step S43 is performed.

Next, a rank determination process is performed (step S43). In this process, CPU 66 reads the strongest winning combination data (D) and the weakest winning combination data (E) of the respective players (P1 to P4) in the player data table (FIG. 12) that were recorded in RAM 70 in the above-described step S43 and in order to determine the ranks in accordance with the read data, prepares strongest winning combination rank determination data (see FIG. 14A) and weakest winning combination rank determination data (see FIG. 14B) and records the prepared data in RAM 70. Player identification data (P1 to P4) are mainly recorded as these rank determination data. When this process is ended, a transfer to step S44 is performed. If two or more players have the same winning combinations, results may be recorded more finely in accordance with the rules of ordinary poker. Or winning combinations that are the same may be handled as a tie.

Next, a winner determination process is performed (step S44). In this process, CPU 66 reads the strongest winning combination rank determination data (see FIG. 14A) and the weakest winning combination rank determination data (see FIG. 14B) that were recorded in RAM 70 in the above-described step S43, reads the player identification data (P1) that has been recorded at the position of the highest of the strongest winning combination ranks and the player identification data (P3) that has been recorded at the position of the lowest of the weakest winning combination ranks and, in accordance with the read data, records "1" in the winner flag (F) of P1 and in the winner flag of P1 in the winner data table (see FIG. 12) positioned in RAM 70. When this process is ended, the present subroutine is ended immediately.

Though with the present embodiment, the player of the highest rank and the player of the lowest rank were determined as winners, this invention is not limited thereto, and the player, who is to be a winner besides the player of the highest rank, may be determined by lottery.

Figure 10:
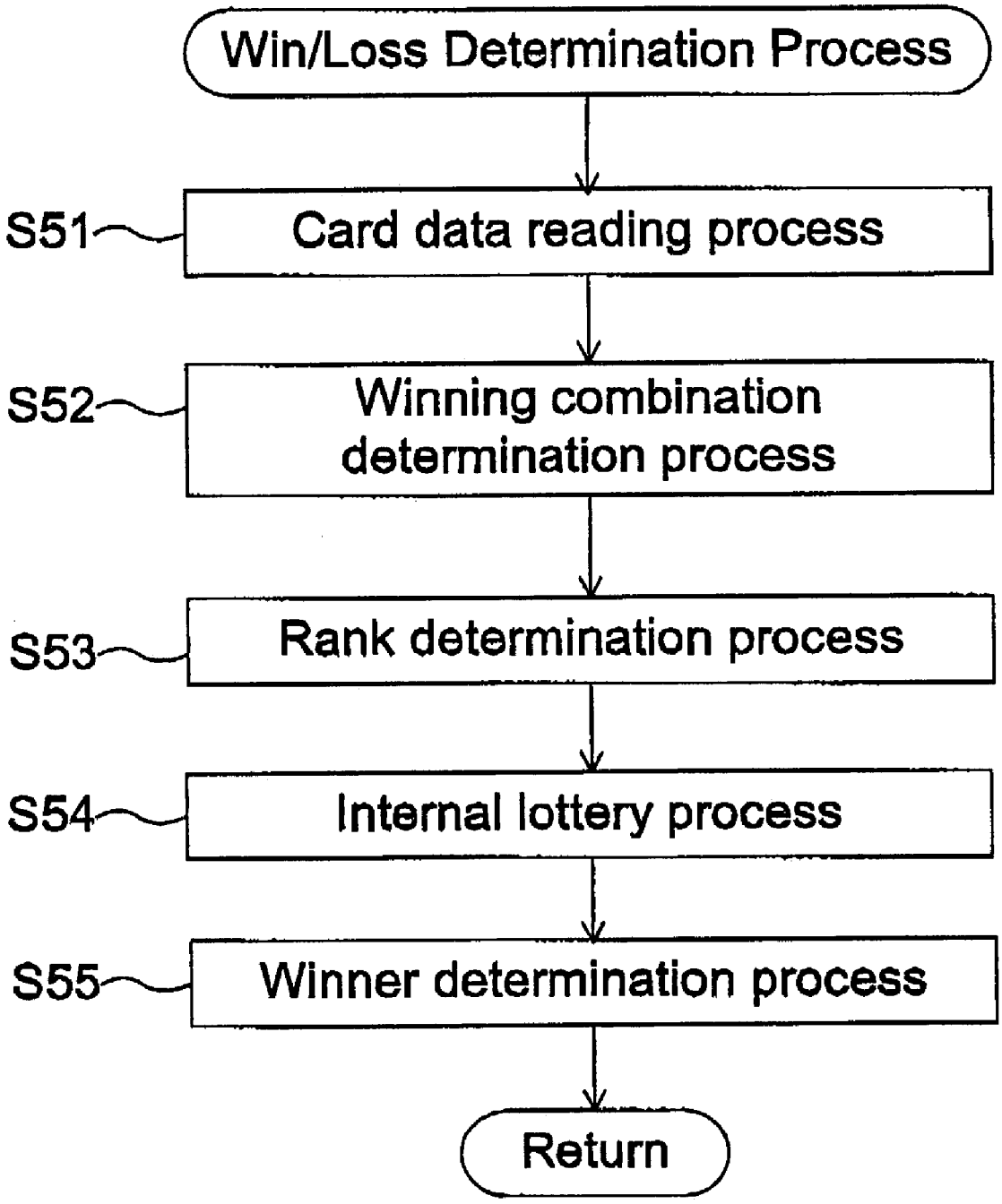
FIG. 10 is a flowchart showing a win/loss determination process executed in a gaming machine according to an embodiment of the present invention.
Figure 11:
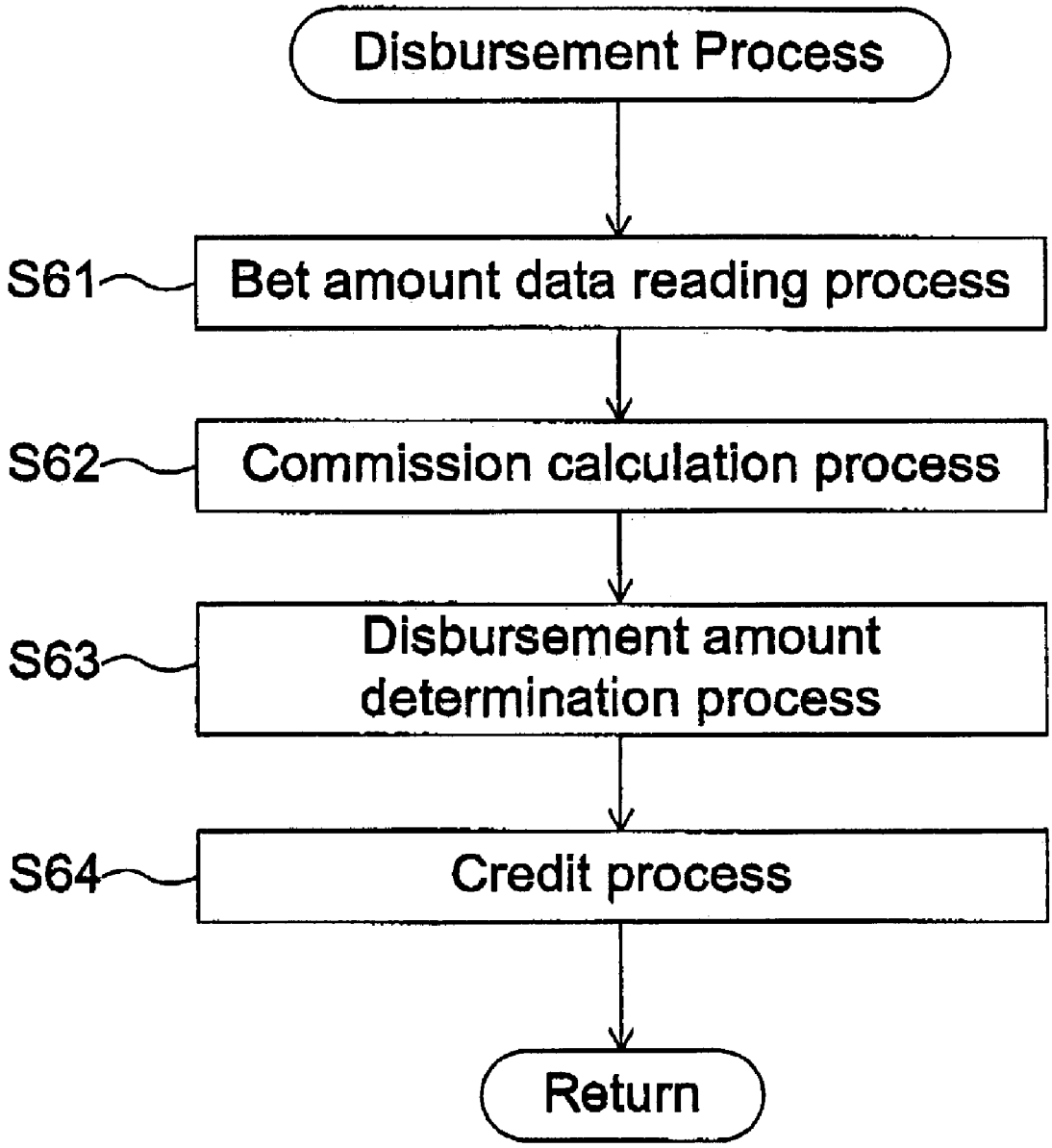
FIG. 11 is a flowchart showing a disbursement process executed in a gaming machine according to an embodiment of the present invention.

A case where the player, who is to be a winner besides the player of the highest rank, is determined by lottery is illustrated in FIG. 10. In this case, a lottery process is performed (step S54). The processes of step SS1 to step S53 is performed in the same manner as the processes of step S41 to step S43 in the above-described win/loss determination process routine illustrated in FIG. 9. In this lottery process, CPU 66, in order to determine the player, besides the player of the highest rank, that is to be a winner by lottery, issues a signal for generating a random number to random number generating part 65 and upon receiving this signal, random number generating part 65 generates a random number of a predetermined range and supplies a signal indicating the value of this random number to CPU 66. In accordance with this generated random number, CPU 66 reads a player identification data from the rank determination data, which were prepared in the above-described rank determination process and recorded in RAM 70. When this process is ended, a transfer to step S55 is performed.

Next, a winner determination process is performed (step S55). In this process, CPU 66 reads the strongest winning combination rank determination data (see FIG. 14A) that was recorded in RAM 70 in step S53, and records "1" in winner flags (F) in the player data table (see FIG. 12) positioned in RAM 70 in accordance with the player identification data (P1) that is recorded at the position of the highest of the strongest winning combination ranks and the player identification data that was read in the above-described step S54. When this process is ended, the present subroutine is ended immediately.

As described above, by arranging so that the "win/loss determination means determines the plurality of players to be provided with benefits so that the plurality of players to be provided with benefits are a combination of the player with the highest rank as determined by the rank determination means and players of ranks that are not in the order of results starting with the highest rank," a player is provided with the opportunity to become a winner in a way other than becoming highest in rank and since this winner determination is carried out in the form of a lottery, a player is left with the possibility of being provided with benefit until the game is finally ended even if his/her rank is not the highest, thus preventing a situation where all players participating in the game lose the will to play the game and increasing the possibility that the game can be enjoyed to the end.

[Disbursement Process]

In the disbursement process routine called in step S14 as described above, the subroutine shown in FIG. 11 is called. First, a bet amount data reading process is performed (step S61). In this process, CPU 66 reads the bet amount data that were recorded in an accumulating manner in RAM 70 in the above-described step 32. When this process is ended, a transfer to step S62 is performed.

Next, a commission calculation process is performed (step S62) In this process, CPU 66 calculates the number of medals to be collected as a commission in accordance with the bet amount data read in the above-described step S61. For example, if a bet amount data is data indicating "60" and 10 percent is to be collected as a commission, CPU 66 records data indicating "6," which is obtained by multiplying the data indicating "60" by 0.1, as commission data (not shown) in RAM 70. When this process is ended, a transfer to step S63 is performed, Next, a disbursement process is performed (step S63). In this process, CPU 66 reads the commission data recorded in RAM 70 in the above-described step S62 and performs the process of subtracting this from the bet amount data read in the above-described step S61. The number of medals to be disbursed to a player is thus calculated. For example, if the above-mentioned bet amount data is data indicating "60" and the commission data is data indicating "6," the data indicating "54," which is obtained by subtracting the data indicating "6", from the data indicating "60," is calculated as the disbursement amount data (not shown).

Also, CPU 66 reads the player data table (see FIG. 12) and judges the players for which "1" is recorded in the winner flag (F). When CPU 66 judges that the players for which "1" is recorded in the winner flag (F) are player P1 and player P3 as shown in FIG. 12, it divides the above-mentioned disbursement amount data of "54" by the number of winners "2" to calculate data indicating "27," which is the amount disbursed to one player. When this process is ended, a transfer to step S64 is performed.

Next, a credit process is performed (step S64). In this process, CPU 66 performs a process of increasing the credit amount displayed in display devices 52. Specifically, CPU 66 supplies player identification data and disbursement amount data to display control device 200.

In accordance with the supplied player identification data and disbursement amount data, display control device 200 makes the credit displayed in display devices 52 (52A to 52D) be the credit resulting from addition.

For example, when disbursement is to be made to player P1 and player P3 as mentioned above, "27" is added to the credit amounts displayed respectively in display device 52A and display device 52C and the results are displayed accordingly. When this process is ended, the present subroutine is ended immediately.

With the present embodiment, since seven cards are dealt to each player and five cards are selected arbitrarily from among the seven cards to determine winning combinations, there is a possibility for both the strongest winning combination and the weakest winning combination to be formed by one player's hand. That is, if a plurality of the conditions for determining a winner are formed by one player's hand, all of the total bet amount will be disbursed to that player. This resolves the problem that the amount disbursed to one player may become reduced due to a plurality of players becoming winners and increases the possibility of preventing the lowering of the players' anticipation for a game.

Also, though with the present embodiment, the total bet amount is divided by the number of players that are to be winners and disbursement is performed uniformly among the players that are to be winners, this invention is not limited thereto, and disbursement may be performed non-uniformly among the players that are to be winners, for example, by disbursing more to the player with the highest result than the player with lowest result.

Furthermore, though with the present embodiment, the benefit to be provided to a winner is provided in the form of disbursement of medals or increase of credit corresponding to medals, this invention is not limited thereto, and as long as a player is transferred to an advantageous game state, a bonus game that provides the right to play a game free of charge, etc., may be provided, etc.

Since by performing the process of the above-described step S42 to step S44, a gaming machine having "a game control means, controlling a game using cards that is played by a plurality of players, including virtual players; and a benefit provision means, providing benefits to the above-mentioned players in accordance with game media used in the above-mentioned game;" is equipped with "a rank determination means, determining ranks in accordance with the results of the above-mentioned game; and a win/loss determination means, determining, in accordance with the ranks determined by the above-mentioned rank determination means, a plurality of players to be provided with the above-mentioned benefits;" and "the above-mentioned win/loss determination means determines the plurality of players to be provided with the above-mentioned benefits so that the plurality of players to be provided with the above-mentioned benefits are a combination of the player with the highest rank as determined by the above-mentioned rank determination means and players of ranks that are not in the order of results starting with the highest rank," benefits can be provided, as a result of the game, to the player with the highest rank as well as to players whose ranks are not in the order of ranks starting from the highest rank.

Though normally in the process of playing a game, a player, who comes to predict that his/her rank will not be the highest and the provision of benefit cannot be expected, may lose the will to play the game and give up, with this invention, since arrangements are made to provide benefits not only to the player with the highest rank but also to players whose ranks are not in the order of ranks starting from the highest rank and a player is thus left with the possibility of being provided with benefit until the game is finally ended even if his/her rank is not the highest, a situation, where all players participating in the game lose the will to play the game, is prevented and the possibility that the game can be enjoyed to the end is increased.

Also, since by performing the process of the above-described step S42 to step S44, the gaming machine of (1) is arranged so that "the above-mentioned win/loss determination means determines the plurality of players to be provided with the above-mentioned benefits so that the plurality of players to be provided with the above-mentioned benefits include the player with the lowest rank as determined by the above-mentioned rank determination means," benefits can be provided, as a result of the game, to the player with the highest rank as well as to the player with the lowest rank.

Though normally in the process of playing a game, a player, who comes to predict that his/her rank will not be the highest and the provision of benefit cannot be expected, may lose the will to play the game and give up, with this invention, since arrangements are made to provide benefits not only to the player with the highest rank but also to the player with the lowest rank and thus even if a player predicts that his/her rank will be of low rank, the player can be made to anticipate becoming the lowest rank and is thus left with the possibility of being provided with benefit until the game is finally ended. The possibility that all players participating in the game will be able to enjoy the game to the end without losing the will to play the game is thus increased.

Though with the present embodiment, a game is performed with the purpose of making players play against each other and the players are not made to play against a computer dealer, this invention is not limited thereto and a game may be performed with the purpose of making players play against each other and, at the same time, the players may be made to play against a computer dealer as well.

[Arrangement Including a Server]

Figure 15:
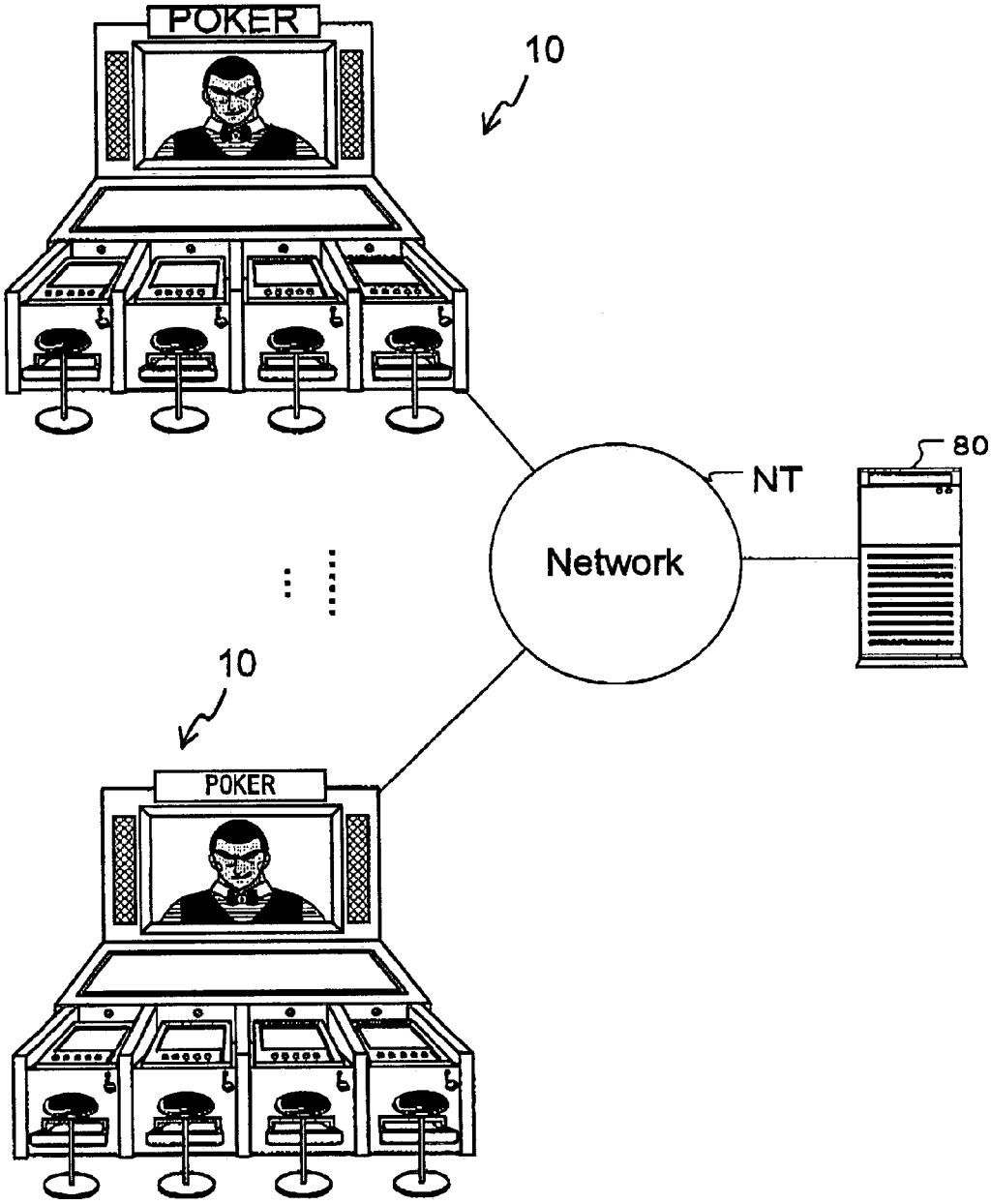
FIG. 15 is a diagram illustrating arrangement of a server and gaming machines connected via a network.

Though the above-described embodiment is arranged from just gaming machine 10, an arrangement in which a server 80 is connected with gaming machines 10 as terminal devices as shown in FIG. 15 is also possible. Specifically, server 80 may be arranged to make the terminal device gaming machines 10 display dealer images, card images, etc., based on operations of players at the terminal device gaming machines 10 and thereby make a game proceed.

That is server 80 control gaming machines 10, which are terminal devices, and is "a server, connectable via a communication line to terminal devices, having information input means for inputting information, and comprising: a game control means, performing, for the above-mentioned terminal devices, control of a game using cards that is played by a plurality of players including virtual players; and a benefit provision means, providing benefits to the above-mentioned players in accordance with input information from the above-mentioned players; a server is provided that furthermore comprises: a rank determination means, determining ranks in accordance with the results of the above-mentioned game; and a win/loss determination means, determining, in accordance with the ranks determined by the above-mentioned rank determination means, a plurality of players to be provided with the above-mentioned benefits; and is characterized in that the above-mentioned win/loss determination means has a function of performing control to determine the plurality of players to be provided with the above-mentioned benefits so that the plurality of players to be provided with the above-mentioned benefits are a combination of the player with the highest rank as determined by the above-mentioned rank determination means and players of ranks that are not in the order of results starting with the highest rank."

With the above, since a server which is "connectable via a communication line to terminal devices having information input means for inputting information and comprising; a game control means, performing, for the above-mentioned terminal devices, control of a game using cards that is played by a plurality of players including virtual players; and a benefit provision means, providing benefits to the above-mentioned players in accordance with input information from the above-mentioned players;" is equipped with "a rank determination means, determining ranks in accordance with the results of the above-mentioned game; and a win/loss determination means, determining, in accordance with the ranks determined by the above-mentioned rank determination means, a plurality of players to be provided with the above-mentioned benefits; " and "the above-mentioned win/loss determination means has a function of performing control to determine the plurality of players to be provided with the above-mentioned benefits so that the plurality of players to be provided with the above-mentioned benefits a combination of the player with the highest rank as determined by the above-mentioned rank determination means and players of ranks that are not in the order of results starting with the highest rank, " benefits can be provided, as a result of the game, to the player with the highest rank as well as to players whose ranks are not in the order of ranks starting from the highest rank.

Though normally in the process of playing a game, a player, who comes to predict that his/her rank will not be the highest and the provision of benefit cannot be expected, may lose the will to play the game and give up, with this invention, since arrangements are made to provide benefits not only to the player with the highest rank but also to players whose ranks are not in the order of ranks starting from the highest rank and a player is thus left with the possibility of being provided with benefit until the game is finally ended even if his/her rank is not the highest, a situation, where all players participating in the game lose the will to play the game, is prevented and the possibility that the game can be enjoyed to the end is increased.

Furthermore, the above arrangement gives rise to the possibility of centralized control of gaming machines from a remote location and provides the above-mentioned effects without requiring the setting of each gaming machine and other troublesome work. Yet furthermore, the objects of the present invention can be achieved by using personal computers, portable telephones, etc., as the terminal devices connected to server 80 and the same actions and effects as those described above may be obtained by arranging server 80 to send, to the terminal devices, image data for display of images on the display parts of such terminal devices, etc., data indicating such image data, audio data, etc., to terminal devices and receive game information input by information input means (for example, the dial buttons of a portable telephone, etc.) equipped in the terminal devices. The above-described embodiment and effects thereof are those that can be considered to be the most favorable arising from this invention, and favorable embodiments and effects of this invention are not limited to those described above.

According to the present invention, since a gaming machine having "a game control means, controlling a game using cards that is played by a plurality of players, including virtual players; and a benefit provision means, providing benefits to the above-mentioned players in accordance with game media used in the above-mentioned game;" is equipped with "a rank determination means, determining ranks in accordance with the results of the above-mentioned game; and a win/loss determination means, determining, in accordance with the ranks determined by the above-mentioned rank determination means, a plurality of players to be provided with the above-mentioned benefits;" and "the above-mentioned win/loss determination means determines the plurality of players to be provided with the above-mentioned benefits so that the plurality of players to be provided with the above-mentioned benefits are a combination of the player with the highest rank as determined by the above-mentioned rank determination means and players of ranks that are not in the order of results starting with the highest rank, " benefits can be provided, as a result of the game, to the player with the highest rank as well as to players whose ranks are not in the order of ranks starting from the highest rank.

Though normally in the process of playing a game, a player, who comes to predict that his/her rank will not be the highest and the provision of benefit cannot be expected, may lose the will to play the game and give up, with this invention, since arrangements are made to provide benefits not only to the player with the highest rank but also to players whose ranks are not in the order of ranks starting from the highest rank and a player is thus left with the possibility of being provided with benefit until the game is finally ended even if his/her rank is not the highest, a situation, where all players participating in the game lose the will to play the game, is prevented and the possibility that the game can be enjoyed to the end is increased.

What is claimed is:

1. A gaming machine comprising:

a game control device for controlling a card game that is played by a plurality of players;

a benefit provision device for providing benefits of the card game to said players;

a rank determination device for determining a player ranking in accordance with a result of the card game; and a win/loss determination device for determining winning players of the card game among the plurality of players to be provided with benefits of the card game;

wherein said win/loss determination device determines the winning players who comprise a combination of the determined highest ranking player and a player other than the highest ranking player determined by lottery, the win/loss determination device selects the player from the plurality of players other than the highest-ranking player.

2. The gaming machine according to claim 1, wherein said card game comprises poker.

3. A gaming machine with which a card game is played by a plurality of players and which provides benefits of the card game to winning players among the plurality of players in accordance with game media used in the card game;

a processor configured to determine said winning players that will receive the benefits of the card game so as to include a highest ranking player according to a result of the card game and another randomely selected player, the processor randomly selects the player from the plurality of players other than the highest-ranking player.

4. A gaming machine with which a plurality of players play a game individually using game media, the game machine comprising:

individual display parts, each of which shows an individual game content for a respective player;

a common display part which shows common information shared with other players;

operating parts, each of which is operated by each individual player; and processor configured to direct benefits of the game to a highest ranking player of the game based on a result of the game and to another player of the game based on a lottery result, the processor selects the another player by lottery from the plurality of players other than the highest-ranking player.

5. A server connectable via a communication link to terminal devices, each of which is for inputting information by a respective player of a card game played by a plurality of players, the server comprising:

a benefit provision device for providing benefits of the game to the plurality of players;

a rank determination device for determining a player ranking in accordance with a result of the game; and a win/loss determination device for determining winning players of the game so as to include a highest ranking player based on the determined ranking and another player based on a lottery result, the win/loss determination device selects the another player by lottery from the plurality of players other than the highest-ranking player.

6. A gaming system on which a game is playable by a plurality of players, comprising:

a data store configured to store logic; and a processor configured to execute the stored logic to (i) determine a ranking of each of the plurality of players from a highest ranking player to a lowest ranking player based on a result of the play of the game, (ii) randomly select one of the plurality of players, the processor randomly selects the one player from the plurality of players other than the determined highest-ranking player and (iii) direct benefits of the game to both the determined highest ranking player and the randomly selected player.

7. The gaming system according to claim 6, wherein:

the processor is further configured to execute the stored logic to determine a total disbursement amount based on amounts bet by the plurality of players in connection with the playing of the game, and to determine a first disbursement amount and a second disbursement amount based on the determined total disbursement amount;

wherein the benefit of the game directed to the determined highest ranking player is the first disbursement amount, and wherein the benefit of the game directed to the randomly selected player is the second disbursement amount.

8. The gaming system according to claim 7, wherein:

the first disbursement amount is greater than the second disbursement amount.

* * * * *

UNITED STATES PATENT AND TRADEMARK OFFICE

CERTIFICATE OF CORRECTION

PATENT NO. : 7,288,024 B2
APPLICATION NO. : 10/612301
DATED : October 30, 2007
INVENTOR(S) : Hirobumi Toyoda It is certified that error appears in the above-identified patent and that said Letters Patent is hereby corrected as shown below:

Column 25, line 45, please insert --a-- before "processor configured to…"

Signed and Sealed this

Eleventh Day of March, 2008

JON W. DUDAS
*Director of the United States Patent and Trademark Office*